US012186637B2

(12) United States Patent
Milleman et al.

(10) Patent No.: US 12,186,637 B2
(45) Date of Patent: Jan. 7, 2025

(54) GOLF CLUB HEADS WITH IMPROVED CHARACTERISTIC TIME

(71) Applicant: KARSTEN MANUFACTURING CORPORATION, Phoenix, AZ (US)

(72) Inventors: Travis D. Milleman, Portland, OR (US); Alexander G. Woodward, Phoenix, AZ (US); Ryan M. Stokke, Anthem, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 676 days.

(21) Appl. No.: 17/447,326

(22) Filed: Sep. 10, 2021

(65) Prior Publication Data

US 2022/0072398 A1 Mar. 10, 2022

Related U.S. Application Data

(63) Continuation-in-part of application No. 17/087,462, filed on Nov. 2, 2020, now Pat. No. 11,850,479, (Continued)

(51) Int. Cl.

| | |
|---|---|
| ***A63B 53/08*** | (2015.01) |
| ***A63B 53/04*** | (2015.01) |
| ***A63B 102/32*** | (2015.01) |

(52) U.S. Cl.

CPC ..... *A63B 53/08* (2013.01); *A63B 53/0408* (2020.08); *A63B 53/0462* (2020.08); *A63B 2102/32* (2015.10)

(58) Field of Classification Search

CPC ..... A63B 53/0408; A63B 53/045; A63B 53/0454; A63B 53/0458; A63B 53/0462; A63B 2102/32

(Continued)

(56) References Cited

U.S. PATENT DOCUMENTS

| | | | |
|---|---|---|---|
| 819,900 | A | 5/1906 | Martin |
| 5,318,300 | A | 6/1994 | Schmidt et al. |

(Continued)

FOREIGN PATENT DOCUMENTS

| | | |
|---|---|---|
| CN | 101244328 | 8/2008 |
| JP | 2880109 | 6/1997 |

(Continued)

OTHER PUBLICATIONS

International Search Report and Written Opinion for PCT Application No. PCT/US2018/031441, 9 pages, Jul. 31, 2018.

*Primary Examiner* — Joseph B Baldori

(57) ABSTRACT

Embodiments of golf club heads comprising a club face with a variable thickness profile to adjust stiffness and characteristic time (CT) are described herein. The variable thickness profile comprises strategically positioned thickened and thinned regions. In many embodiments, variable thickness profile can taper from a thickened region to a thinned region. The thickened region can comprise a maximum thickness of the club face, and the thinned region can comprise a minimum thickness of the club face. The variable thickness profiles described in this disclosure increase stiffness in a high toe area of the club face and decrease stiffness in a heel area of the club face.

19 Claims, 11 Drawing Sheets

Related U.S. Application Data which is a continuation-in-part of application No. 15/973,386, filed on May 7, 2018, now Pat. No. 11,161,019, application No. 17/447,326 is a continuation-in-part of application No. 15/973,386, filed on May 7, 2018, now Pat. No. 11,161,019.

(60) Provisional application No. 63/127,869, filed on Dec. 18, 2020, provisional application No. 63/082,925, filed on Sep. 24, 2020, provisional application No. 63/076,723, filed on Sep. 10, 2020, provisional application No. 62/928,986, filed on Oct. 31, 2019, provisional application No. 62/608,363, filed on Dec. 20, 2017, provisional application No. 62/502,482, filed on May 5, 2017.

(58) Field of Classification Search
USPC ..... 473/282, 324, 329, 332, 333, 345, 346, 473/349, 350
See application file for complete search history.

(56) References Cited

U.S. PATENT DOCUMENTS 5,676,605 A 10/1997 Kobayashi
5,797,807 A 8/1998 Moore
5,830,084 A 11/1998 Kosmatka
5,921,869 A 7/1999 Blough
5,954,596 A 9/1999 Noble
5,971,868 A 10/1999 Kosmatka
5,993,331 A 11/1999 Shieh
6,319,150 B1 11/2001 Werner
6,354,962 B1 3/2002 Galloway
6,368,234 B1 4/2002 Galloway
6,381,828 B1 5/2002 Boyce
6,428,426 B1 8/2002 Helmstetter
6,478,693 B2 11/2002 Matsunaga
6,508,722 B1 1/2003 McCabe
6,602,150 B1 8/2003 Kosmatka
6,605,007 B1 8/2003 Bissonnette
6,623,377 B2 9/2003 Evans
6,679,786 B2 1/2004 McCabe
6,800,038 B2 10/2004 Willett
6,841,014 B2 1/2005 Huang
6,899,638 B2 5/2005 Iwata
6,904,663 B2 6/2005 Willett
6,966,848 B2 11/2005 Kusumoto
7,014,570 B2 3/2006 Evans
7,018,303 B2 3/2006 Yamamoto
7,018,305 B2 3/2006 Sugimoto
7,029,403 B2 4/2006 Rice
7,066,833 B2 6/2006 Yamamoto
7,126,339 B2 10/2006 Nagai
7,137,907 B2 11/2006 Gibbs
7,144,337 B2 12/2006 Hirano
7,207,898 B2 4/2007 Rice
7,220,190 B2 5/2007 Hirano
7,261,643 B2 8/2007 Rice
7,278,925 B2 10/2007 Oyama
7,331,877 B2 2/2008 Yamaguchi
7,338,388 B2 3/2008 Schweigert
7,347,794 B2 3/2008 Schweigert
7,367,899 B2 5/2008 Rice
7,413,517 B2 8/2008 Butler, Jr.
7,435,189 B2 10/2008 Hirano
7,442,132 B2 10/2008 Nishio
7,549,934 B2 6/2009 Rice
7,578,755 B2 8/2009 Oyama
7,585,232 B2 9/2009 Krumme
7,614,964 B2 11/2009 Matsunaga
7,618,331 B2 11/2009 Hirano
7,658,687 B2 2/2010 Hirano
7,704,162 B2 4/2010 Rice
7,744,486 B2 6/2010 Hou
7,753,808 B2 7/2010 Matsunaga
7,762,907 B2 7/2010 Rice
7,780,547 B2 8/2010 Ban
7,785,213 B2 8/2010 Matsunaga
7,850,541 B2 12/2010 Meyer
7,874,937 B2 1/2011 Chao
7,874,938 B2 1/2011 Chao
7,935,003 B2 5/2011 Matsunaga
7,980,963 B2 7/2011 Rice
8,038,544 B2 10/2011 Meyer
8,047,930 B2 11/2011 Rice
8,047,931 B2 11/2011 Yokota
8,251,834 B2 8/2012 Curtis
8,262,501 B2 9/2012 Curtis
8,272,975 B2 9/2012 Morin
8,277,334 B2 10/2012 Meyer
8,277,336 B2 10/2012 Hirano
8,353,786 B2 1/2013 Beach
8,382,609 B2 2/2013 Yokota
8,435,137 B2 5/2013 Hirano
8,439,769 B2 5/2013 Rice
8,550,935 B2 10/2013 Stites
8,715,107 B2 5/2014 Brunski
8,727,908 B2 5/2014 Goto
8,826,512 B2 9/2014 Schweigert
8,932,150 B2 1/2015 Ines
8,956,246 B2 2/2015 Myrhum
8,986,133 B2 3/2015 Bennett
9,044,653 B2 6/2015 Wahl
9,101,809 B2 8/2015 Gibbs
9,162,115 B1 10/2015 Beach
9,168,436 B2 10/2015 Slaughter
9,192,828 B2 11/2015 Curtis
9,220,954 B2 12/2015 Matsunaga
9,320,949 B2 4/2016 Golden
9,433,835 B2 9/2016 Sugimae
9,526,956 B2 12/2016 Murphy
9,623,292 B2 4/2017 Abe
9,636,552 B2 5/2017 Cleghorn
9,669,270 B2 6/2017 Schweigert
9,675,849 B2 6/2017 Beach
9,901,789 B2 2/2018 Kitagawa
9,914,030 B2 3/2018 Cleghorn
9,937,389 B2 4/2018 Kitagawa
9,937,390 B2 4/2018 Luttrell
9,950,219 B2 4/2018 Larson
9,987,524 B2 6/2018 Jertson
10,207,163 B2 2/2019 Mizutani
10,213,662 B2 2/2019 Seluga
10,758,789 B2 9/2020 Bacon
11,318,358 B1 * 5/2022 Story ..... A63B 53/0458
11,554,298 B2 * 1/2023 Simone ..... A63B 60/42
11,850,479 B2 * 12/2023 Morales ..... A63B 53/0412
11,925,844 B2 * 3/2024 Milleman ..... B32B 25/20
11,969,632 B2 * 4/2024 Milleman ..... A63B 53/0408
2003/0181257 A1 9/2003 Yamamoto
2006/0052179 A1 3/2006 Hou
2006/0128501 A1 6/2006 Rice
2011/0159987 A1 6/2011 Takechi
2013/0109500 A1 5/2013 Boyd
2015/0119166 A1 4/2015 Deshmukh
2015/0328506 A1 11/2015 Morales
2016/0067560 A1 * 3/2016 Golden ..... A63B 53/0466 473/333
2016/0067561 A1 * 3/2016 Golden ..... A63B 53/0466 473/342
2016/0096083 A1 4/2016 Boggs et al.
2018/0001160 A1 1/2018 Abe
2018/0078832 A1 * 3/2018 Stokke ..... A63B 53/04
2018/0318666 A1 * 11/2018 Morales ..... A63B 60/00
2018/0318667 A1 11/2018 Wester
2019/0046845 A1 * 2/2019 Greensmith ..... C22C 14/00
2019/0076705 A1 * 3/2019 Greaney ..... A63B 53/04
2019/0192927 A1 * 6/2019 Bacon ..... A63B 53/0466
2020/0139208 A1 * 5/2020 Johnson ..... A63B 60/002
2021/0316194 A1 * 10/2021 Deshmukh ..... A63B 53/0458
2022/0184468 A1 * 6/2022 Greaney ..... A63B 53/0408
2023/0338793 A1 * 10/2023 Milleman ..... A63B 53/0475

(56) References Cited

U.S. PATENT DOCUMENTS

| | | | | |
|---|---|---|---|---|
| 2024/0017139 | A1* | 1/2024 | Bacon | A63B 60/02 |
| 2024/0050814 | A1* | 2/2024 | Bacon | A63B 53/0437 |
| 2024/0131402 | A1* | 4/2024 | Bacon | A63B 53/06 |

FOREIGN PATENT DOCUMENTS

| | | |
|---|---|---|
| JP | 2002239040 | 8/2002 |
| JP | 3352315 | 9/2002 |
| JP | 2002315854 | 10/2002 |
| JP | 2003117032 | 4/2003 |
| JP | 4719113 | 4/2011 |
| JP | 5698168 | 2/2015 |
| JP | 5795919 | 8/2015 |
| JP | 5998092 | 9/2016 |

* cited by examiner

GOLF CLUB HEADS WITH IMPROVED CHARACTERISTIC TIME

CROSS REFERENCE TO RELATED APPLICATIONS

This claims the benefit of U.S. Provisional Patent Application No. 63/127,869, filed on Dec. 18, 2020, U.S. Provisional Patent Application No. 63/082,925, filed on Sep. 24, 2020, and U.S. Provisional Patent Application No. 63/076,723, filed on Sep. 10, 2020, and is a continuation-in-part of U.S. patent application Ser. No. 17/087,462, filed on Nov. 2, 2020, which claims the benefit of U.S. Provisional Patent Application No. 62/928,986, filed on Oct. 31, 2019. U.S. patent application Ser. No. 17/087,462 is also a continuation-in-part of U.S. patent application Ser. No. 15/973,386, filed on May 7, 2018, and is issued as U.S. Pat. No. 11,161,019 on Nov. 2, 2021, which claims the benefit of U.S. Provisional Patent Application No. 62/608,363, filed on Dec. 20, 2017, and U.S. Provisional Patent Application No. 62/502,482, filed on May 5, 2017. This is further a continuation-in-part of U.S. patent application Ser. No. 15/973,386, filed on May 7, 2018, and is issued as U.S. Pat. No. 11,161,019 on Nov. 2, 2021, which claims the benefit of U.S. Provisional Patent Application No. 62/608,363, filed on Dec. 20, 2017, and U.S. Provisional Patent Application No. 62/502,482, filed on May 5, 2017. The contents of all the above-described disclosures are incorporated fully herein by reference in their entirely.

FIELD OF THE INVENTION

This invention generally relates to golf equipment, and more particularly, to golf club head faces having a variable face thickness profiles to adjust stiffness and maintain characteristic time (CT) requirements.

BACKGROUND

Golf club design takes into account several performance characteristics, such as forgiveness, ball speed, and characteristic time (CT). Typically, golf club designs aim to take these performance characteristics into account under regulations from the United States Golf Association (USGA). For example, characteristic time (CT) is taken into account when designing a club head that meets the regulations of the USGA. However, current golf club designs have variable or inconsistent CT performance across various locations on club face. The inconsistent CT performance across the club face provides inconsistent ball speed or ball distance thereby diminishing the feel or playability of the club head. Therefore, there is a need in the art for alternative wood-type club head designs that increase CT within the USGA requirements while minimizing CT variability across the club face.

DETAILED DESCRIPTION

Figure 1:
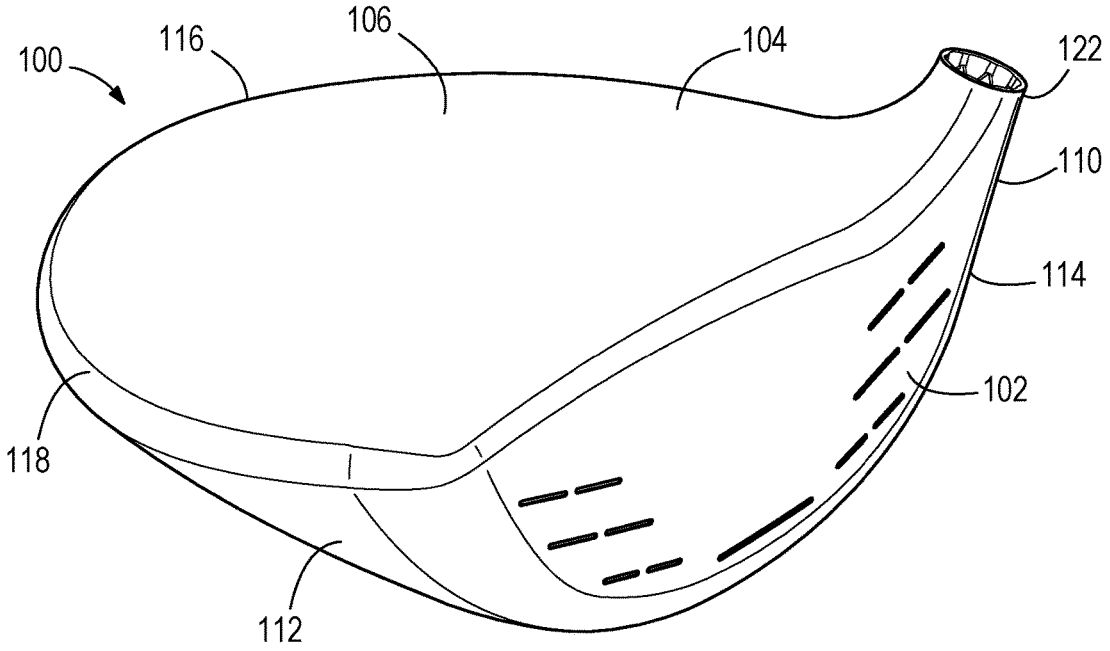
FIG. 1 illustrates a top perspective view of a wood-type club head.

The present embodiments are directed to wood-type club heads (e.g. drivers, fairway woods, or hybrids) comprising club faces with variable thickness profiles to adjust stiffness and characteristic time (CT). The club faces described in this disclosure increase or maximize characteristic time (CT) within the United States Golf Association (USGA) regulations while reducing CT variability across the club face (e.g. in a heel to toe direction, or in a sole to crown direction).

To achieve consistent characteristic time across the club face, the club face comprises a variable thickness profile having strategically positioned thickened and thinned regions. The variable thickness profiles described in this disclosure increase the stiffness of the club face within a high toe area of the club face while decreasing the stiffness of the club face within a heel area of the club face. Increasing the stiffness of the club face decreases the CT, and decreasing the stiffness of the club face increases the CT. Increasing high toe stiffness and decreasing heel stiffness can be accomplished by designing the club face with 1) a variable thickness profile that is shifted and angled from the face center, 2) a variable thickness profile that comprises a toe side width greater than a heel side width, and/or 3) a variable thickness profile that comprises a perimeter region with thickened and thinned portions (i.e. a perimeter region with a variable thickness).

The variable thickness profiles described in this disclosure reduce large CT gaps (i.e. greater than 10 μs) for measurements between the toe area, center area, and heel area of the club face. More consistency is achieved when CT measurements do not deviate greatly at locations between the toe area, face center, and the heel area of the club face. Consistent CT improves ball performance for center and off-center hits thereby improving the feel and playability of the club head. The club heads described in this disclosure are devoid of ribs or structures that reinforce the club face. The club head described in this disclosure are devoid of ribs or structures that contact the club face. Described below are a few embodiments of the present design that reduce the CT variability across the club face.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements but may include other elements not expressly listed or inherent to such process, method, system, article, device, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the apparatus, methods, and/or articles of manufacture described herein are, for example, capable of operation in other orientations than those illustrated or otherwise described herein.

The term characteristic time "CT" is used herein to mean a measurement used to determine the amount of time, measured in microseconds (μs), that a golf ball contacts the club face at the moment of impact. The characteristic time is measured by impacting a specific spot on the striking surface several times using a small steel pendulum. The characteristic time measurement is for wood-type club heads such as drivers, fairway woods, or hybrids. A computer program measures the amount of time the steel pendulum contacts the club face at the moment of impact. CT values were based on the method outlined in the USGA's Procedure for Measuring the Flexibility of a Golf Clubhead. For example, Section 2 of the USGA's Procedure for Measuring the Flexibility of a Golf Clubhead (USGA-TPX3004, Rev. 2.0, Apr. 9, 2019) (the "Protocol For Measuring The Flexibility of A Golf Club Head").

As defined herein, "spline method" refers to a method to determine the location where the curvature of a surface changes. For example, the spline method can be used to determine where the surface curvature deviates from a bulge and roll curvature of the striking surface of a golf club head. The spline method can be implemented by imposing a spline onto the curved surface with an interval such that the spline indicates where a significant change in curvature begins.

The terms "loft" or "loft angle" of a golf club, as described herein, refers to the angle formed between the club face and the shaft, as measured by any suitable loft and lie machine.

"Drivers golf club heads" as used herein comprise a loft angle less than approximately 16 degrees, less than approximately 15 degrees, less than approximately 14 degrees, less than approximately 13 degrees, less than approximately 12 degrees, less than approximately 11 degrees, or less than approximately 10 degrees. Further, in many embodiments, "driver golf club heads" as used herein comprises a volume greater than approximately 400 cc, greater than approximately 425 cc, greater than approximately 445 cc, greater than approximately 450 cc, greater than approximately 455 cc, greater than approximately 460 cc, greater than approximately 475 cc, greater than approximately 500 cc, greater than approximately 525 cc, greater than approximately 550 cc, greater than approximately 575 cc, greater than approximately 600 cc, greater than approximately 625 cc, greater than approximately 650 cc, greater than approximately 675 cc, or greater than approximately 700 cc. In some embodiments, the volume of the driver can be approximately 400 cc-600 cc, 425 cc-500 cc, approximately 500 cc-600 cc, approximately 500 cc-650 cc, approximately 550 cc-700 cc, approximately 600 cc-650 cc, approximately 600 cc-700 cc, or approximately 600 cc-800 cc.

"Fairway wood golf club heads" as used herein comprise a loft angle less than approximately 35 degrees, less than approximately 34 degrees, less than approximately 33 degrees, less than approximately 32 degrees, less than approximately 31 degrees, or less than approximately 30 degrees. Further, in some embodiments, the loft angle of the fairway wood club heads can be greater than approximately 12 degrees, greater than approximately 13 degrees, greater than approximately 14 degrees, greater than approximately 15 degrees, greater than approximately 16 degrees, greater than approximately 17 degrees, greater than approximately 18 degrees, greater than approximately 19 degrees, or greater than approximately 20 degrees. For example, in other embodiments, the loft angle of the fairway wood can be between 12 degrees and 35 degrees, between 15 degrees and 35 degrees, between 20 degrees and 35 degrees, or between 12 degrees and 30 degrees.

Further, "fairway wood golf club heads" as used herein comprises a volume less than approximately 400 cc, less than approximately 375 cc, less than approximately 350 cc, less than approximately 325 cc, less than approximately 300 cc, less than approximately 275 cc, less than approximately 250 cc, less than approximately 225 cc, or less than approximately 200 cc. In some embodiments, the volume of the fairway wood can be approximately 150 cc-200 cc, approximately 150 cc-250 cc, approximately 150 cc-300 cc, approximately 150 cc-350 cc, approximately 150 cc-400 cc, approximately 300 cc-400 cc, approximately 325 cc-400 cc, approximately 350 cc-400 cc, approximately 250 cc-400 cc, approximately 250-350 cc, or approximately 275-375 cc.

"Hybrid golf club heads" as used herein comprise a loft angle less than approximately 40 degrees, less than approximately 39 degrees, less than approximately 38 degrees, less than approximately 37 degrees, less than approximately 36 degrees, less than approximately 35 degrees, less than approximately 34 degrees, less than approximately 33 degrees, less than approximately 32 degrees, less than approximately 31 degrees, or less than approximately 30 degrees. Further, in many embodiments, the loft angle of the hybrid can be greater than approximately 16 degrees, greater than approximately 17 degrees, greater than approximately 18 degrees, greater than approximately 19 degrees, greater than approximately 20 degrees, greater than approximately 21 degrees, greater than approximately 22 degrees, greater than approximately 23 degrees, greater than approximately 24 degrees, or greater than approximately 25 degrees.

Further, "hybrid golf club heads" as used herein comprise a volume less than approximately 200 cc, less than approximately 175 cc, less than approximately 150 cc, less than approximately 125 cc, less than approximately 100 cc, or less than approximately 75 cc. In some embodiments, the volume of the hybrid can be approximately 100 cc-150 cc, approximately 75 cc-150 cc, approximately 100 cc-125 cc, or approximately 75 cc-125 cc.

The golf club heads described in this disclosure can be formed from a metal, a metal alloy, a composite, or a combination of metals and composites. For example, the golf club head can be formed from, but not limited to, steel, steel alloys, stainless steel alloys, nickel, nickel alloys, cobalt, cobalt alloys, titanium alloys, an amorphous metal alloy, or other similar materials. For further example, the golf club head can be formed from, but not limited to, C300 steel, C350 steel, 17-4 stainless steel, or T9s+ titanium.

Other features and aspects will become apparent by consideration of the following detailed description and accompanying drawings. Before any embodiments of the disclosure are explained in detail, it should be understood that the disclosure is not limited in its application to the details or embodiment and the arrangement of components as set forth in the following description or as illustrated in the drawings. The disclosure is capable of supporting other embodiments and of being practiced or of being carried out in various ways. It should be understood that the description of specific embodiments is not intended to limit the disclosure from covering all modifications, equivalents and alternatives falling within the spirit and scope of the disclosure. Also, it is to be understood that the phraseology and terminology used herein is for the purpose of description and should not be regarded as limiting.

General Description of a Wood-Type Club Head

Referring to the drawings, wherein like reference numerals are used to identify like or identical components in various views, FIGS. 1-5 schematically illustrate a wood-type golf club head in various views. Specifically, FIG. 1 illustrates a front perspective view of a wood-type club head 100. The club head can comprise a club face 102 and a body 104 secured together to define a substantially closed/hollow interior volume. The club head 100 comprises a crown 106, a sole 108 opposite the crown 106, a heel 110, a toe 112 opposite the heel 110, a front 114, and a rear 116 opposite the front 114. The body 104 can further include a skirt or trailing edge 118 located between and adjoining the crown 106 and the sole 108, the skirt 118 extending from near the heel 110 to near the toe 112 of the club head 100.

The club head 100 is a wood-type club head such as a driver, fairway wood, or hybrid as described in this disclosure. The club face 102 and the body 104 can define an internal cavity of the club head 100. The body 104 can extend over the crown 106, the sole 108, the heel 110, the toe 112, the rear 116, and a perimeter of the front 114. In these embodiments, the body 104 defines an opening on the front 116 of the club head 100 and the club face 102 is positioned within the opening to form the club head 100. In other embodiments, the club face 102 extends over the perimeter of the front 116 and can include a return portion extending over at least one of the crown 108, the sole 110, the heel 112, and the toe 114 (not shown). In embodiments comprising the return portion, the return portion of the club face 102 is secured to the body 102 to form the club head 100. In these embodiments, the club head 100 can resemble a cup face or face wrap design.

As illustrated in FIGS. 1-4, the club head 100 comprises a hosel structure 122. The hosel structure 122 is capable of receiving a hosel sleeve and a golf shaft, wherein the hosel sleeve can be coupled to an end of the golf shaft (not shown). The hosel sleeve can be coupled with the hosel structure in a plurality of configurations, thereby permitting the golf shaft to be secured to the hosel structure at a plurality of angles.

The club head 100 can further comprise a weight port 120 configured to receive a removable weight. In many embodiments, the weight port 120 can be located in the sole 108 and/or in the skirt 118. The removable weight can adjust the moment of inertia (MOI) properties and center of gravity (CG) location.

The club face 102 comprises a striking surface 124 intended to impact a golf ball, and a rear surface 126 opposite the striking surface 124. The striking surface 124 further defines a face center or geometric center 128. In some embodiments, the face center 128 can be located at a geometric center point of a face perimeter 130. In another approach, the face center 128 of the striking surface 124 can be located in accordance with the definition of a golf governing body such as the United States Golf Association (USGA).

Referring to FIGS. 1-5, the club face perimeter 130 can be located along an outer edge of the striking surface 124, where the curvature of the striking surface 124 deviates from the bulge and roll curvature. The striking surface 124 comprises a striking surface area measured within the boundary of the club face perimeter 130, where the curvature of the striking surface 124 deviates from the bulge and roll curvature. In one approach, the spline method, as described above, can be used to determine the location of the outer edge where the curvature deviates from the bulge and roll of the striking surface 124.

Further, a club face height can be measured parallel to a loft plane 132 between a top end of the face perimeter 130 and a bottom end of the face perimeter 130. The top end of the face perimeter 130 is located near the crown 106 and the bottom end of the face perimeter 130 is located near the sole 108.

Figure 2:
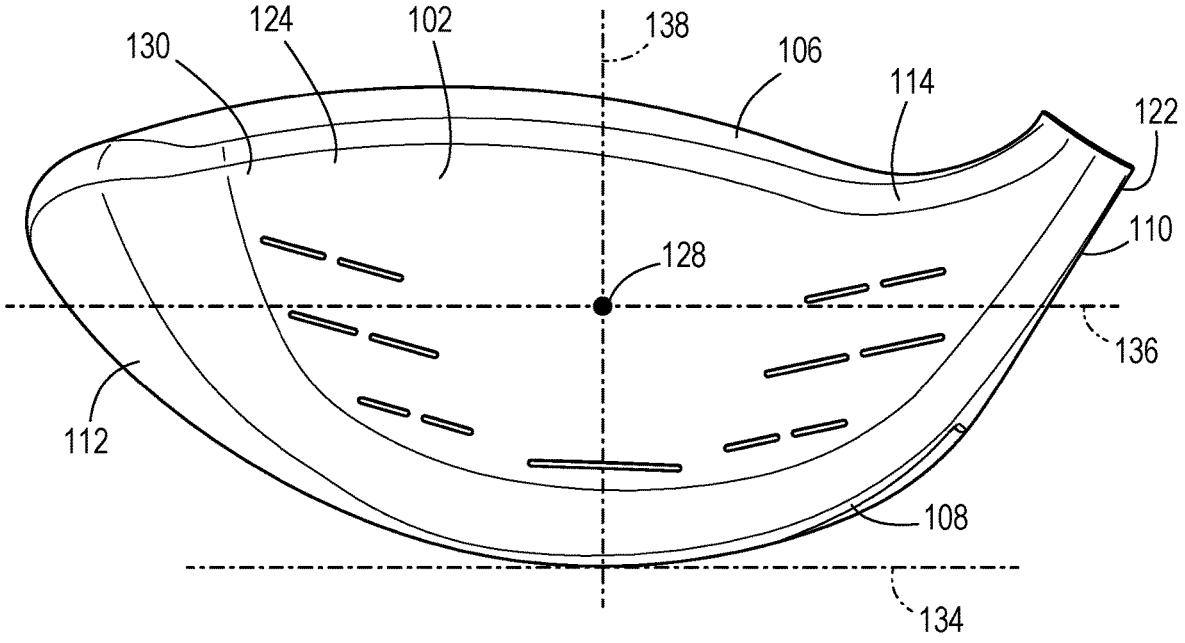
FIG. 2 illustrates a front perspective view of the club head of FIG. 1.
Figure 3:
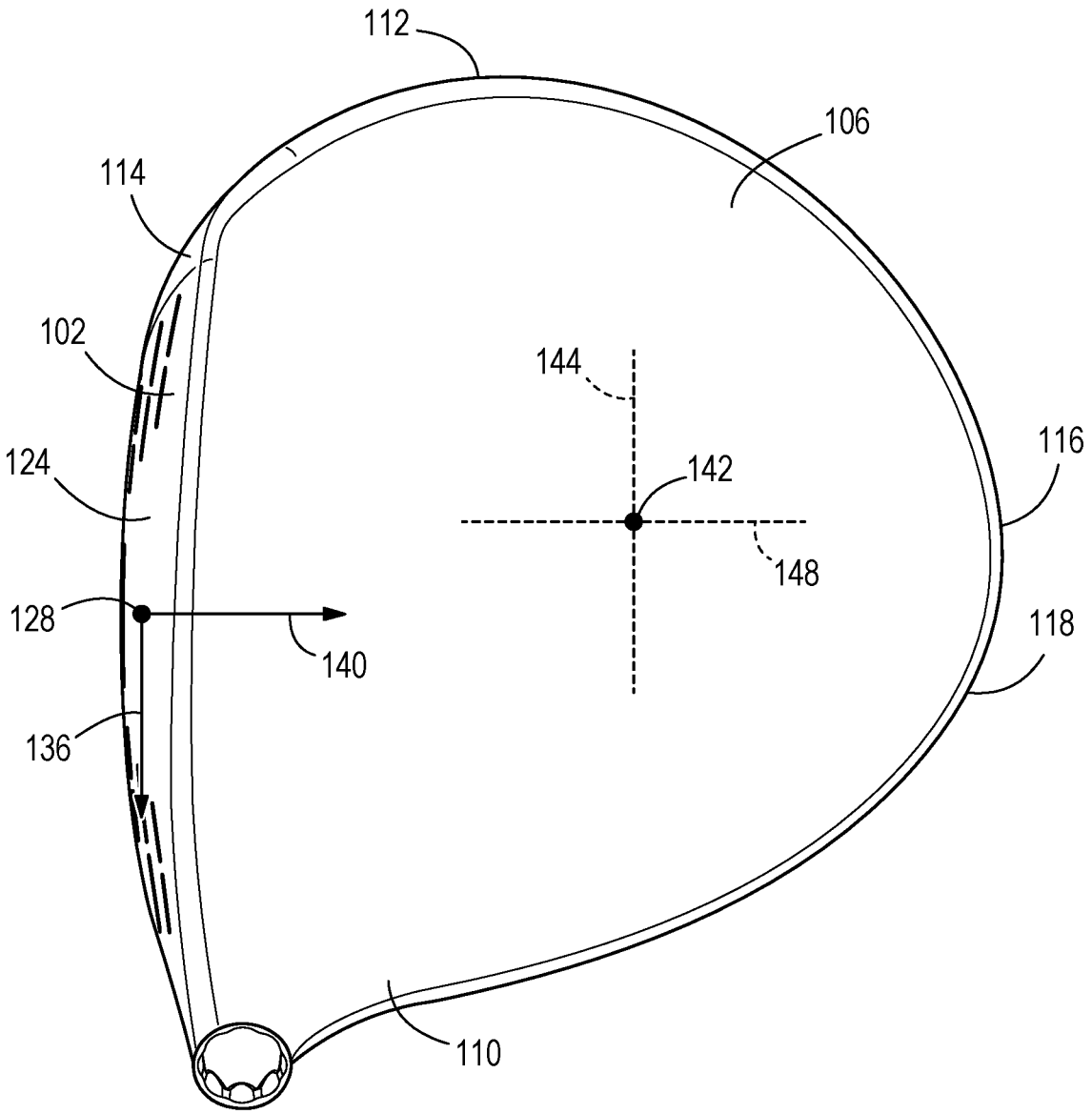
FIG. 3 illustrates a top view of the club head of FIG. 1.
Figure 4:
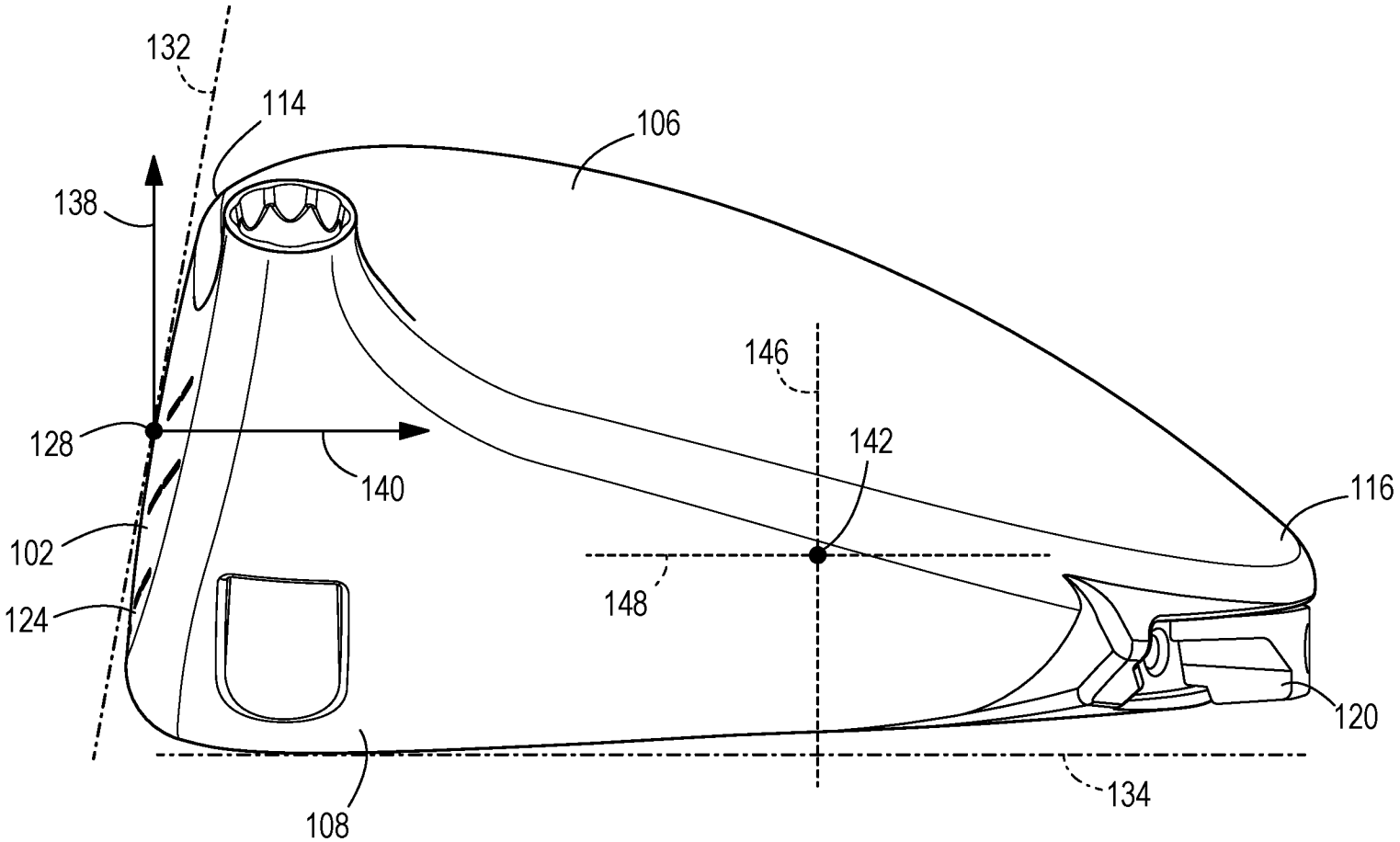
FIG. 4 illustrates a heel view of the club head of FIG. 1.

Referring to FIGS. 2-4, the club head 100 defines the loft plane 132 tangent to the face center 128 of the striking surface 124. The club head 100 defines a ground plane 134 tangent to the sole 108 when the club head 100 is at an address position. The face center 128 of the striking surface 124 defines an origin for a coordinate system having an x-axis 136, a y-axis 138, and a z-axis 140. The x-axis 136 is a horizontal axis that extends through the face center 128 in a direction extending from near the heel 110 to near the toe 112 parallel to the ground plane 134. The y-axis 138 is a vertical axis that extends through the face center 128 in a direction extending from near the sole 108 to near the crown 106 perpendicular to the ground plane 134. The y-axis 138 is perpendicular to the x-axis 136. The z-axis 140 is a horizontal axis that extends through the face center 128 in a direction extending from near the front 114 to near the rear 116 parallel to the ground plane 134. The z-axis 140 is perpendicular to the x-axis 136 and the y-axis 138. The x-axis 136 extends in a positive direction toward the heel 110. The y-axis 138 extends in a positive direction toward the crown 106. The z-axis 140 extends in a positive direction toward the rear 116.

As illustrated in FIGS. 3 and 4, the club head 100 further comprises a center of gravity (CG) 142. In many embodiments, the center of gravity 142 is located within the coordinate system defined above. The center of gravity 142 can have a location on the x-axis 136, the y-axis 138, and the z-axis 140. The center of gravity 142 further defines an origin of coordinate system having a CG x-axis 144, a CG y-axis 146, and a CG z-axis 148. The CG x-axis 136 extends through the CG 142 from near the heel 110 to near the toe 112. The CG y-axis extends through the CG 142 from near the crown 106 to near the sole 108, the CG y-axis 146 is perpendicular to the CG x-axis 144. The CG z-axis 148 extends through the CG 142 from near the front 114 to near the rear 116, perpendicular to both the CG x-axis 144 and the CG y-axis 146.

The CG x-axis 144 is parallel to the x-axis 136, the CG y-axis 146 is parallel to the y-axis 138, and the CG z-axis is parallel to the z-axis 140. In many embodiments, the center of gravity 142 is strategically positioned toward the sole 108 and the rear 116 of the club head 100. The club faces described in this disclosure can be part of the club head 100 comprising a low and rear CG position to provide the club head 100 improved feel and playability.

The club head 100 further comprises a moment of inertia Ixx about the CG x-axis 144 (i.e. crown-to-sole moment of inertia) and a moment of inertia Iyy about the CG y-axis 146 (i.e. heel-to-toe moment of inertia). As described in more detail below, the crown-to-sole moment of inertia Ixx and the heel-to-toe moment of inertia Iyy are increased or maximized to provide a high forgiving club head. The club faces described in this disclosure can be part of the club head 100 comprising a high moment of inertia Ixx and a high moment of inertia Iyy. The high moment of inertia Ixx and the high moment of inertia Iyy provide the club head 100 improved feel, forgiveness, and playability.

General Club Face Description

The present embodiments are directed to wood-type club heads (e.g. drivers, fairway woods, or hybrids) comprising club faces with variable thickness profiles to adjust stiffness and characteristic time (CT). The club faces described in this disclosure increase or maximize characteristic time within the United States Golf Association (USGA) regulations while reducing CT variability across the club face 102.

To achieve consistent characteristic time across the club face, the club face 102 comprises a variable thickness profile having strategically positioned thickened and thinned regions. The thickness of the club face 102 can be measured from the striking surface 124 to the rear surface 126 in a direction perpendicular to the loft plane 132. The variable thickness profile of club face 102 increases the stiffness within the high toe area of the club face while decreasing the stiffness within the heel area of the club face. Increasing club face stiffness decreases the CT, and decreasing club face stiffness increases the CT. As described below in various embodiments, increasing high toe stiffness and decreasing heel stiffness can be accomplished by designing the club face with 1) a variable thickness profile that is shifted and angled from a face center, 2) a variable thickness profile that comprises a toe side width greater than a heel side width, and/or 3) a variable thickness profile that comprises a perimeter region with thickened and thinned portions (i.e. a perimeter region with a variable thickness).

In embodiments wherein the thickened region is centrally located on the club face 102, the thickened center region can comprise a shape when viewing the rear surface 126 of the club face 102. The thickened center region can comprise an elliptical, oval, circular, egg, quadrilateral, asymmetric elliptical, rhombus, or oblong-ellipse shape. As described in more detail below, the shape of the thickened center region can adjust stiffness (i.e. increase high toe stiffness and decrease heel stiffness) thereby tuning the characteristic time across the club face 102.

Figure 5:
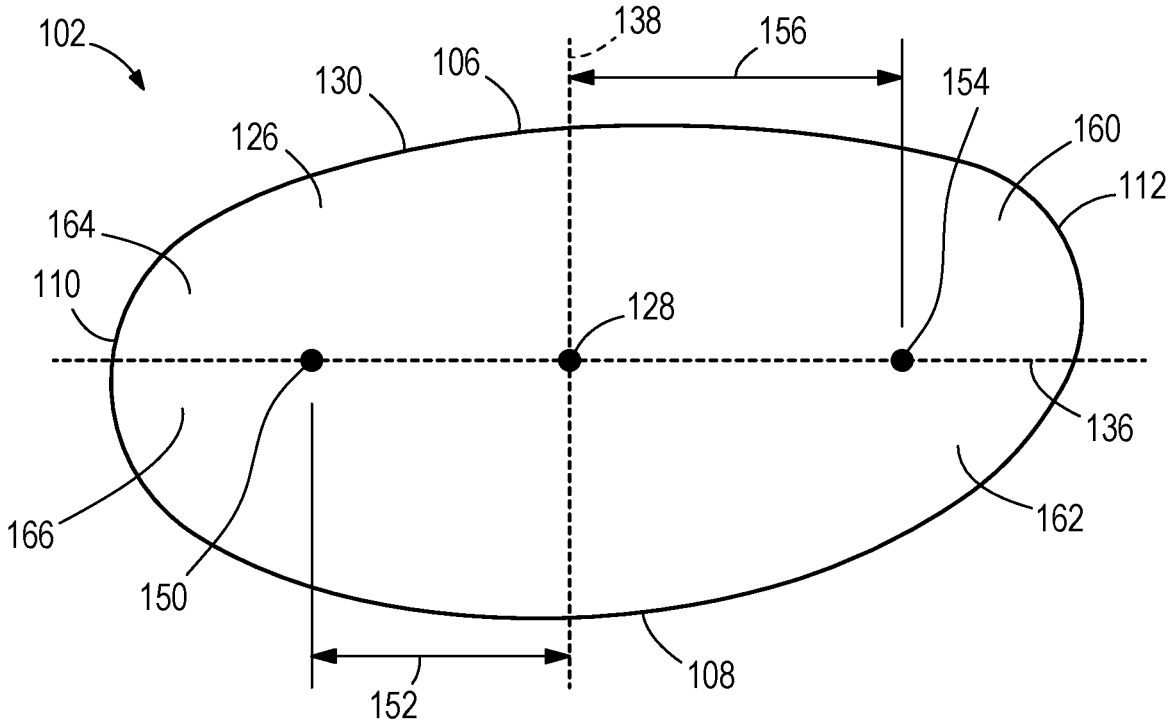
FIG. 5 illustrates a club face rear surface view comprising an origin at a face center defining four quadrants.

FIG. 5 illustrates a rear view of the club face 102. Specifically, FIG. 5 illustrates the rear surface 126 of the club face 102. The face center 128 defines an origin for a quadrant system. Specifically, the x-axis 136 and the y-axis 138 divide the striking surface 124 into four quadrants including a high toe quadrant 160, a low toe quadrant 162, a high heel quadrant 164, and a low heel quadrant 166. The high toe quadrant 160 can define a high toe and a top area of the striking surface 124. The low toe quadrant 162 can define a low toe and a bottom area of the striking surface 124. The high heel quadrant 164 can define a high heel and the top area of the striking surface 124. The low heel quadrant 166 can define a low heel and the bottom area of the striking surface 124. With reference to the variable thickness profile, in one example, the thickened center region can be located within all the quadrants, wherein a majority of the thickened center region can be located within the high toe quadrant 160 thereby increasing the high toe stiffness.

Further, with reference to the quadrant system, the club face 102 weight can be divided between the four quadrants. Each quadrant comprises a percent of the total weight of the club face 102. To achieve increased high toe stiffness, the high toe quadrant 160 comprises the largest percentage of the club face 102 weight. To achieve decreased heel stiffness, the low heel quadrant 162 comprises the lowest percentage of the club face 102 weight. For example, in many embodiments, the percentage of the total faceplate weight in the high toe quadrant 160 can range between 28% to 40%. In other embodiments, the percentage of the total faceplate weight in the high toe quadrant 160 can range between 28% to 35%, 29% to 36%, 30% to 37%, 31% to 38%, 32% to 39%, or 33% to 40%. For example, the percentage of the total faceplate weight in the high toe quadrant 160 can be 28, 29, 30, 31, 32, 33, 34, 35, 36, 37, 38, 39, or 40%.

In many embodiments, the percentage of the total faceplate weight in the high heel quadrant 164 can range between 18% to 28%. In other embodiments, the percentage of the total faceplate weight in the high heel quadrant 164 can range between 18% to 25%, 19% to 26%, 20% to 27%, or 21% to 28%. For example, the percentage of the total faceplate weight in the high heel quadrant 164 can be 18, 19, 20, 21, 22, 23, 24, 25, 26, 27, or 28%.

In many embodiments, the percentage of the total faceplate weight in the low heel quadrant 166 can range between 15% to 25%. In other embodiments, the percentage of the total faceplate weight in the low heel quadrant 166 can range between 15% to 22%, 16% to 23%, 17% to 24%, or 18% to 25%. For example, the percentage of the total faceplate weight in the low heel quadrant 166 can be 15, 16, 17, 18, 19, 20, 21, 22, 23, 24, or 25%.

In many embodiments, the percentage of the total faceplate weight in the low toe quadrant 162 can range between 18% to 28%. In other embodiments, the percentage of the total faceplate weight in the low toe quadrant 162 can range between 18% to 25%, 19% to 26%, 20% to 27%, or 21% to 28%. For example, the percentage of the total faceplate weight in the low toe quadrant 162 can be 18, 19, 20, 21, 22, 23, 24, 25, 26, 27, or 28%.

With continued reference to FIG. 5, the characteristic time (CT) of the club face 102 can be measured at the face center 128, and at one or more reference points. The one or more reference points can be measured at specific intervals or increments along the x-axis 136. For example, the one or more reference points can be measured along the horizontal x-axis 136 at intervals of approximately 5 mm or 10 mm, or at intervals of 0.21 inch or 0.42 inch.

As illustrated in FIG. 5, in one example, a first reference point 150 can be offset from the face center 128 toward the heel 110, and a second reference point 154 can be offset from the face center 128 toward the toe 112. The first reference point 150 can be offset from the face center 128 by a horizontal offset distance 152, and the second reference point 156 can be offset from the face center 128 by a horizontal offset distance 156. In one example, the CT can be measured at 10 mm intervals along the x-axis 136 between the first reference point 150 and the second reference point 154, wherein the first offset distance 152 is approximately 20 mm toward the heel 110 and the second offset distance 156 is approximately 20 mm toward the toe 112. In another example, the CT can be measured at 5 mm intervals between the first reference point 150 and the second reference point 154, wherein the first offset distance 152 is approximately 20 mm toward the heel 110 and the second offset distance 156 is approximately 20 mm toward the toe 112.

Various club faces with variable face thickness profiles are described below to achieve the advantages of reduced CT variability across the club face 102. The various club faces described in this disclosure increase stiffness in the high toe area of the club face 102 and decrease stiffness in the heel area of the club face 102. For example, as described in more detail below, the CT when measured at 10 mm intervals along the x-axis 136 between the first reference point 150 and the second reference point 154 deviates less than 10 μs from the CT at the face center 128, wherein the first reference point 150 is approximately 10 mm toward the heel 110 and the second reference point 154 is approximately 20 mm toward the toe 112. CT measurements that deviate less than 10 μs from the CT measured at the face center 128 provide improved ball performance for center and off-center hits.

First Embodiment of a Club Face Variable Thickness Profile

Described below is a first embodiment of the present design that increases high toe stiffness and decreases heel stiffness. The first embodiment achieves this stiffness profile by comprising a variable thickness profile that is shifted and angled toward the high toe from the face center. The first embodiment comprises an elliptical center region that is shifted and angled from the face center to increase high toe stiffness. Further, the first embodiment comprises a thinned perimeter region to decrease heel stiffness. Further still, the shifting and angling of the variable thickness profile of the second embodiment moves the thickened region away from the heel area of the club face thereby decreasing heel stiffness. The first embodiment decreases CT values in the high toe area and increases CT values in the heel area thereby reducing the gap between CT for measurement locations across the club face.

Figure 6:
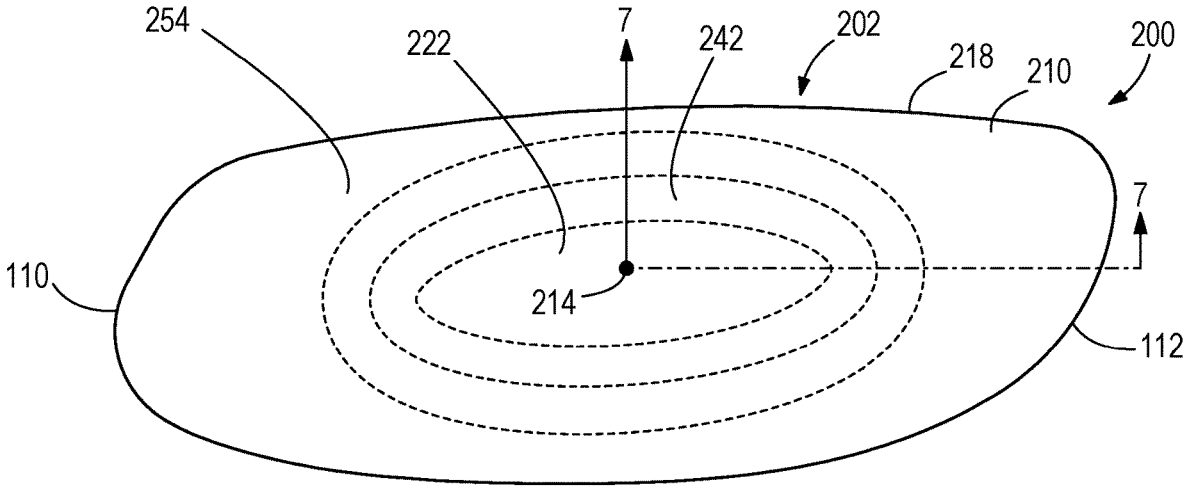
FIG. 6 illustrates a rear surface view of a club face comprising a variable thickness profile that is shifted and angled with respect to a face center.
Figure 7:
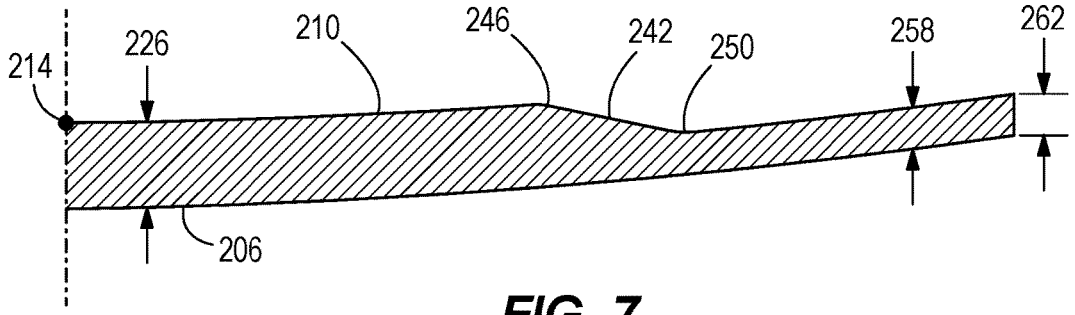
FIG. 7 illustrates a cross sectional view of the club face of FIG. 6 taken at line 7-7.
Figure 8:
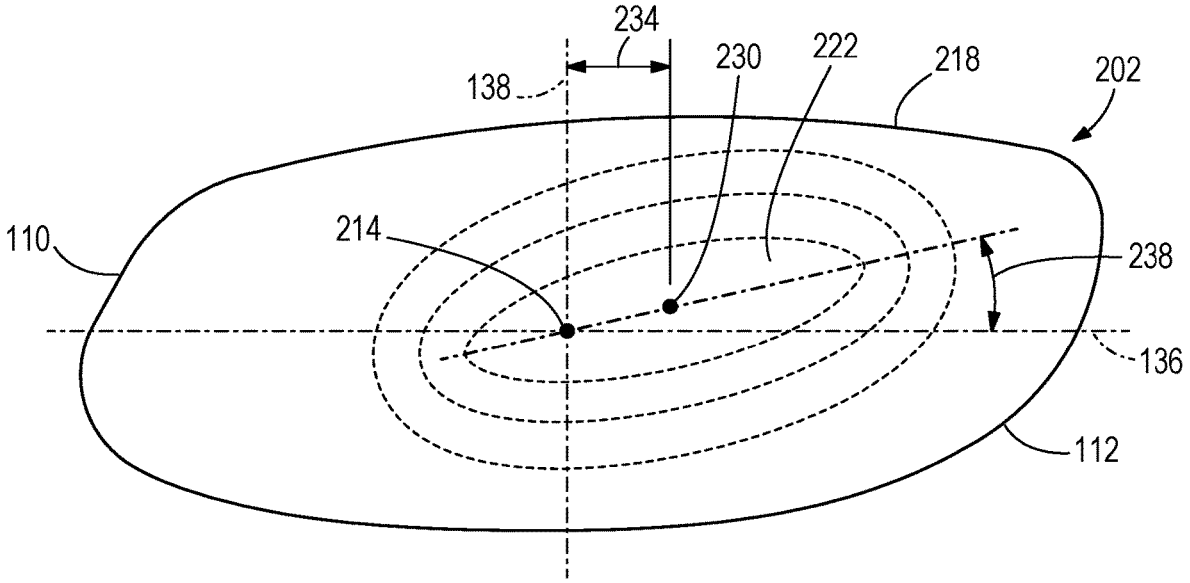
FIG. 8 illustrates a rear surface view of the club face comprising the variable thickness profile that is shifted and angled with respect to the face center of FIG. 6.

FIGS. 6-8 illustrates the first embodiment comprising a club face 202 for a wood-type club head 200. The club head 200 can be similar to the club head 100 described above. The club face 202 can be similar to the club face 102 described above. The club face 202 comprises a striking surface 206 for impacting a golf ball, and a rear surface 210 opposite the striking surface 206. The club face 202 comprises a variable thickness profile extending between a face center 214 and a face perimeter 218. The variable thickness profile of the club face 202 can taper from a thickened portion to a thinned portion to adjust stiffness and the characteristic time.

Specifically, as illustrated in FIGS. 6-8, the variable thickness profile of club face 202 includes a center region 222, a transition region 242, and a perimeter region 254. The center region 222 encompasses the face center 214 of the club face 202. The center region 222 comprises a center thickness 226 that can be constant. In many embodiments, the center region 222 comprises a maximum thickness of the club face 202. The center region 222 comprises an elliptical shape, or oblong-ellipse shape when viewing the rear surface 210 of the club face 202.

The center thickness 226 can be less than or equal to 0.15 inch, less than or equal to 0.10 inch, less than or equal to 0.09 inch, or less than or equal to 0.08 inch. In other embodiments, the center thickness 226 can range from 0.05 to 0.10 inch. In other embodiments, the center thickness 226 can range from 0.05 to 0.075 inch, or 0.075 to 0.10 inch. For example, the center thickness 226 can be 0.05, 0.06, 0.065, 0.07, 0.075, 0.078, 0.08, 0.081, 0.085, 0.09, 0.095, or 0.10 inch. In one example, the center thickness 226 can be 0.078 inch.

Further, as illustrated in FIG. 8, the center region 222 can encompass a center region center 230 that is offset from the face center 214 by an offset distance 234. It would be appreciated that FIG. 8 illustrates an exaggerated view of the offset distance to help improve understanding of the first embodiment. In many embodiments, the center region center 230 can be offset from the face center 214 in a direction toward the crown, the sole, and/or the toe. As illustrated in FIG. 8, the center region center 230 can be offset in a direction toward the toe and/or crown. Described another way, the center region center 230 can be offset from the x-axis 136 in a direction toward the crown or the sole. Further, described another way, the center region center 230 can be offset from the y-axis 138 in a direction toward the toe.

The offset distance 234 can be measured in a direction extending from the face center 214 to the center region center 230 parallel to the x-axis 136. In many embodiments, the offset distance 234 can range from greater than 0 inch to 0.35 inch. In other embodiments, the offset distance 234 can range from greater than 0 to 0.2 inch, 0.1 to 0.3 inch, or 0.15 to 0.35 inch. For example, the offset distance 234 can be 0.05, 0.1, 0.15, 0.16, 0.17, 0.18, 0.19, 0.2, 0.21, 0.22, 0.23, 0.24, 0.25, 0.3, or 0.35 inch. In one example, the offset distance 234 can be 0.2 inch.

Further, as illustrated in FIG. 8, the center region center 230 can be offset from face center 214 at an offset angle 238 to the x-axis 136. It would be appreciated that FIG. 8 illustrates an exaggerated view of the offset angle to help improve understanding of the first embodiment. The offset angle 238 of the center region center 230 can be measured between the x-axis 136 and a line extending through the face center 214 and the center region center 230 (i.e. a line extending radially or in a direction a radius from the face center 214). In many embodiments, the offset angle 238 can range from 0 to 10 degrees. In other embodiments, the offset angle 238 can range from 0 to 5 degrees, or 5 to 10 degrees. In other embodiments still, the offset angle 238 can range from 0 to 8 degrees, 1 to 9 degrees, or 2 to 10 degrees. For example, the offset angle 238 can be 0, 1, 2, 3, 4, 5, 6, 7, 8, 9, or 10 degrees. In one example, the offset angle 238 can be 5 degrees.

Referring back to FIGS. 6 and 7, the transition region 242 abuts or contacts the center region 222. The transition region 242 comprises a transition thickness that varies in a direction extending from the face center 214 to the face perimeter 218. In many embodiments, the transition thickness decreases or tapers in a direction extending from the face center 214 to the face perimeter 218. The transition region 242 can comprise one or more arcuate surfaces. The arcuate surfaces of the transition region 242 smoothly blend or gradually taper the club face 202 thickness between the center region 222 and the perimeter region 254. In one example, the transition region 242 can comprise a first arcuate surface 246 including a first radius of curvature, and a second arcuate surface 250 including a second radius of curvature. The first arcuate surface 246 abuts or contacts the center region 222 and the second arcuate surface 250 abuts or contacts the perimeter region 254. The first arcuate surface 246 can be convex when viewed normal to the rear surface 210 of the club face 202, and the second arcuate surface 250 can be concave when viewed normal to the rear surface 210 of the club face 202.

The perimeter region 254 abuts or contacts the transition region 242. The perimeter region 254 further abuts or contacts the face perimeter 218. In many embodiments, the perimeter region 254 comprises a perimeter thickness 258 that can be constant. In other embodiments, the perimeter thickness 258 can be constant in the toe area and the heel area of the club face 202, wherein the perimeter thickness 258 in the toe area of the club face 202 can be greater the perimeter thickness 258 in the heel area of the club face 202. In many embodiments, the perimeter region 254 comprises a minimum thickness of the club face 202. The perimeter region 254 further comprises a peripheral thickness 262 at the face perimeter 218 or measured at an edge of the club face 202 closest to the face perimeter 218. The peripheral thickness 262 can be equal or different than the perimeter thickness 258.

The perimeter thickness 258 can be greater than or equal to 0.05 inch, greater than or equal to 0.06 inch, greater than or equal to 0.065 inch, greater than or equal to 0.07 inch, greater than or equal to 0.08 inch, or greater than or equal to 0.09 inch. In other embodiments, the perimeter thickness 258 can range from 0.05 to 0.10 inch. In some embodiments, the perimeter thickness 258 can range from 0.05 to 0.075 inch, or 0.075 to 0.10 inch. In some embodiments, the perimeter thickness 258 can range from 0.05 to 0.06 inch, 0.06 to 0.07 inch, 0.07 to 0.08 inch, 0.08 to 0.09 inch, or 0.09 to 0.10 inch. For example, the perimeter thickness 258 can be approximately 0.05, 0.055, 0.06, 0.063, 0.065, 0.07, 0.075, 0.08, 0.085, 0.09, 0.095, or 0.10 inch. In another example, the perimeter thickness 258 can be 0.063 inch.

The variable thickness profile of club face 202 reduces the characteristic time variability across the club face 202. Specifically, the thickened center region 222 is shifted and angled to increase the stiffness in the high toe area of the club face 202. Increasing stiffness in the high toe area of the club face 202 decreases the characteristic time. Further, the thinned perimeter region 254 decreases the stiffness in the heel area of the club face 202 to increase the characteristic time. The variable thickness profile of the club face 202 reduces characteristic time variability across the club face 202 and allows the characteristic time values to not deviate greatly from the characteristic time at the face center 214. Further, the variable thickness profile of the club face 202 allows the characteristic time values to not deviate greatly between measurement locations at the heel area and high toe area of the club face 202.

For example, the characteristic time at the first reference point 150 at approximately a 10 mm offset along the horizontal x-axis 136 from the face center 214 in a direction toward the heel deviates less than 10 μs from the characteristic time at the face center 214. In another example, the characteristic time at the second reference point 154 at approximately a 10 mm offset along the horizontal x-axis 136 from the face center 214 in a direction toward the toe deviates less than 10 μs from the characteristic time at the face center 214. In another example still, the characteristic time at the second reference point 154 at approximately a 20 mm offset along the horizontal x-axis 136 from the face center 214 in a direction toward the toe deviates less than 10 μs from the characteristic time at the face center 214. Characteristic time values that deviate less than 10 μs provide consistent ball performance for hits at the face center and off-center hits.

Second Embodiment of a Club Face Variable Thickness Profile

Described below is a second embodiment of the present design that increases high toe stiffness and decreases heel stiffness. The second embodiment achieves this stiffness profile by comprising a variable thickness profile having a toe side width greater than a heel side width. The second embodiment further achieves this stiffness profile by comprising an oblong-ellipse center region that is shifted and angled toward the high toe from the face center. The second embodiment comprising the variable thickness profile having the toe side width greater than the heel side width increases high toe stiffness. The second embodiment comprising the variable thickness profile that is shifted and angled toward the high toe from the face center further increases high toe stiffness. Further, the second embodiment comprises a thinned perimeter region to decrease heel stiffness. Further still, the shifting and angling of the variable thickness profile of the second embodiment moves the thickened region away from the heel area of the club face thereby decreasing heel stiffness. The second embodiment decreases CT values in the high toe area and increase CT values in the heel area thereby reducing the gap between CT for measurement locations across the club face.

Figure 9:
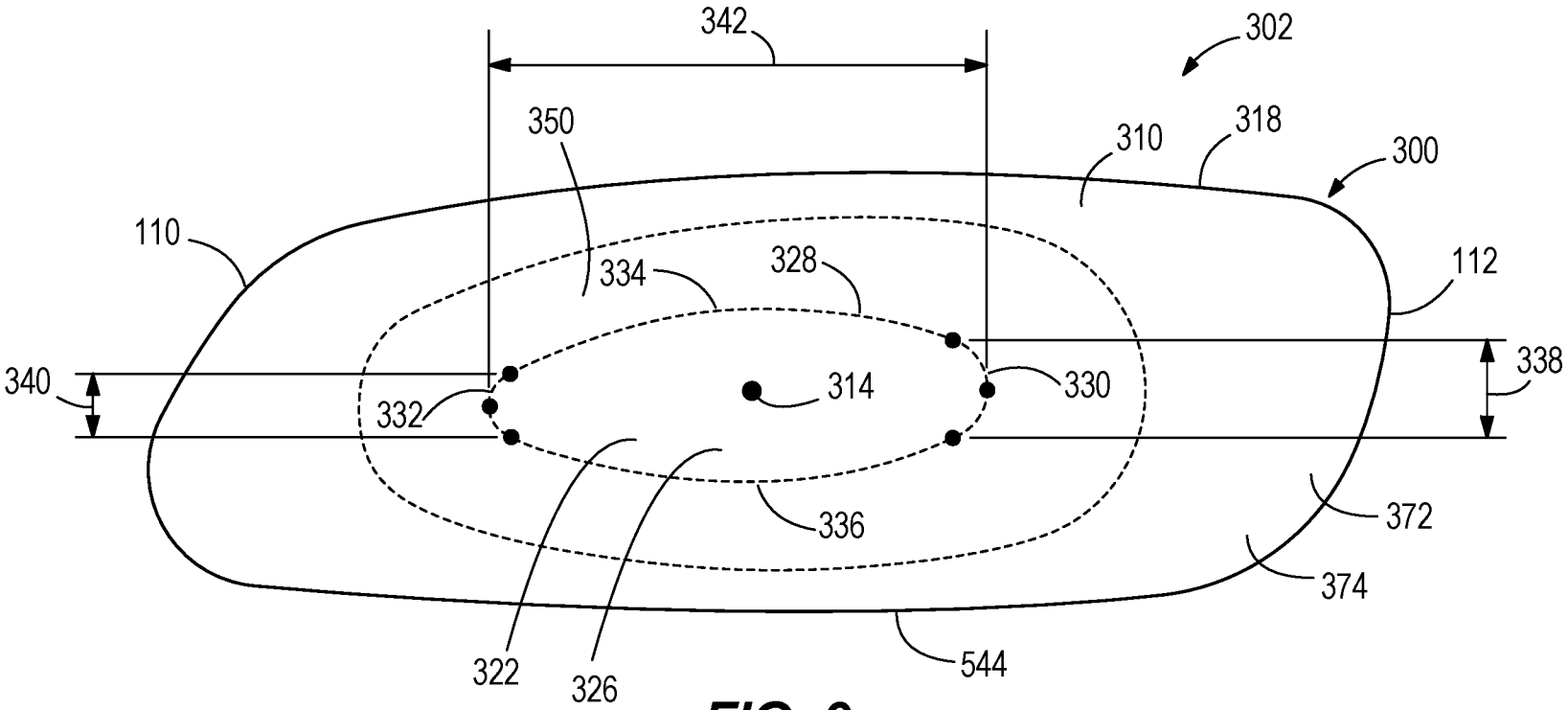
FIG. 9 illustrates a rear surface view of a club face comprising a variable thickness profile having a toe side width greater than a heel side width.
Figure 10:
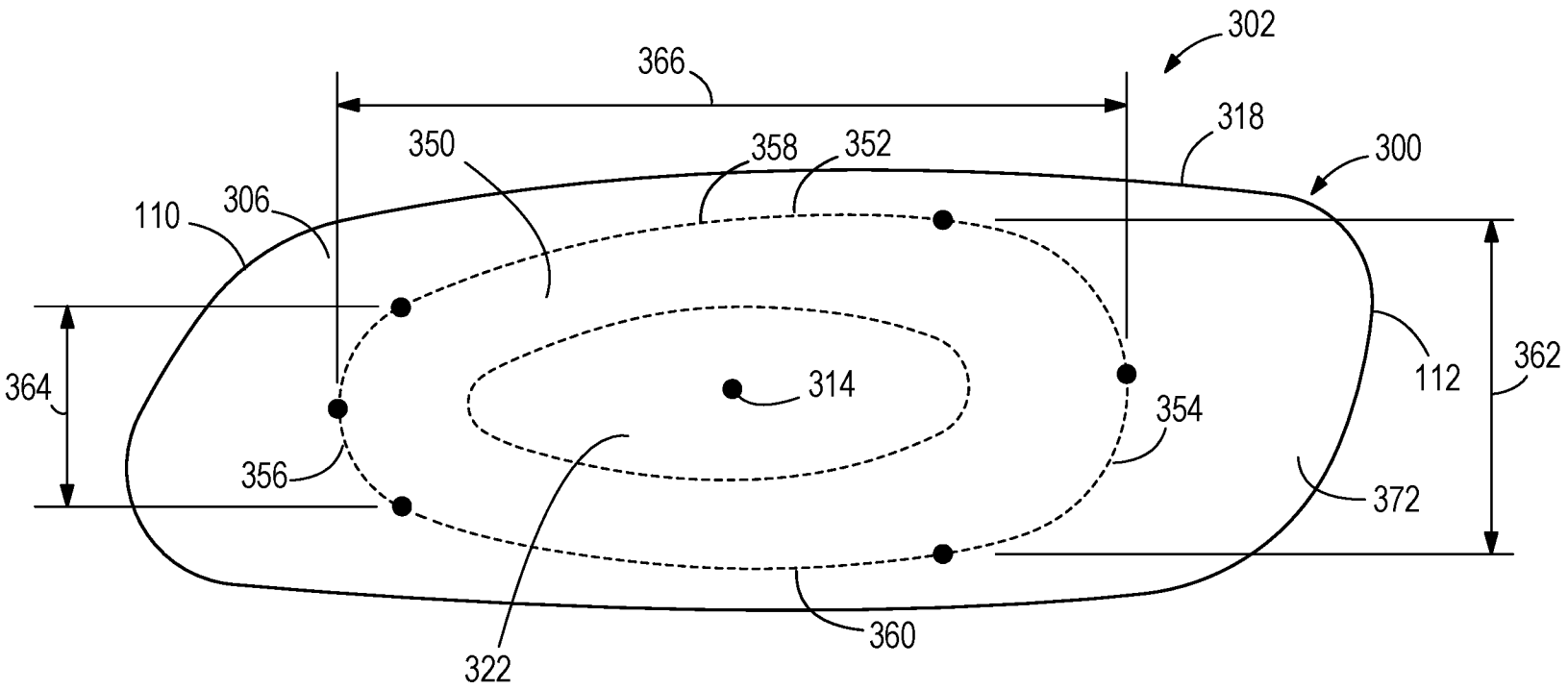
FIG. 10 illustrates a rear surface view of the club face comprising the variable thickness profile having the toe side width greater than the heel side width of FIG. 9.
Figure 11:
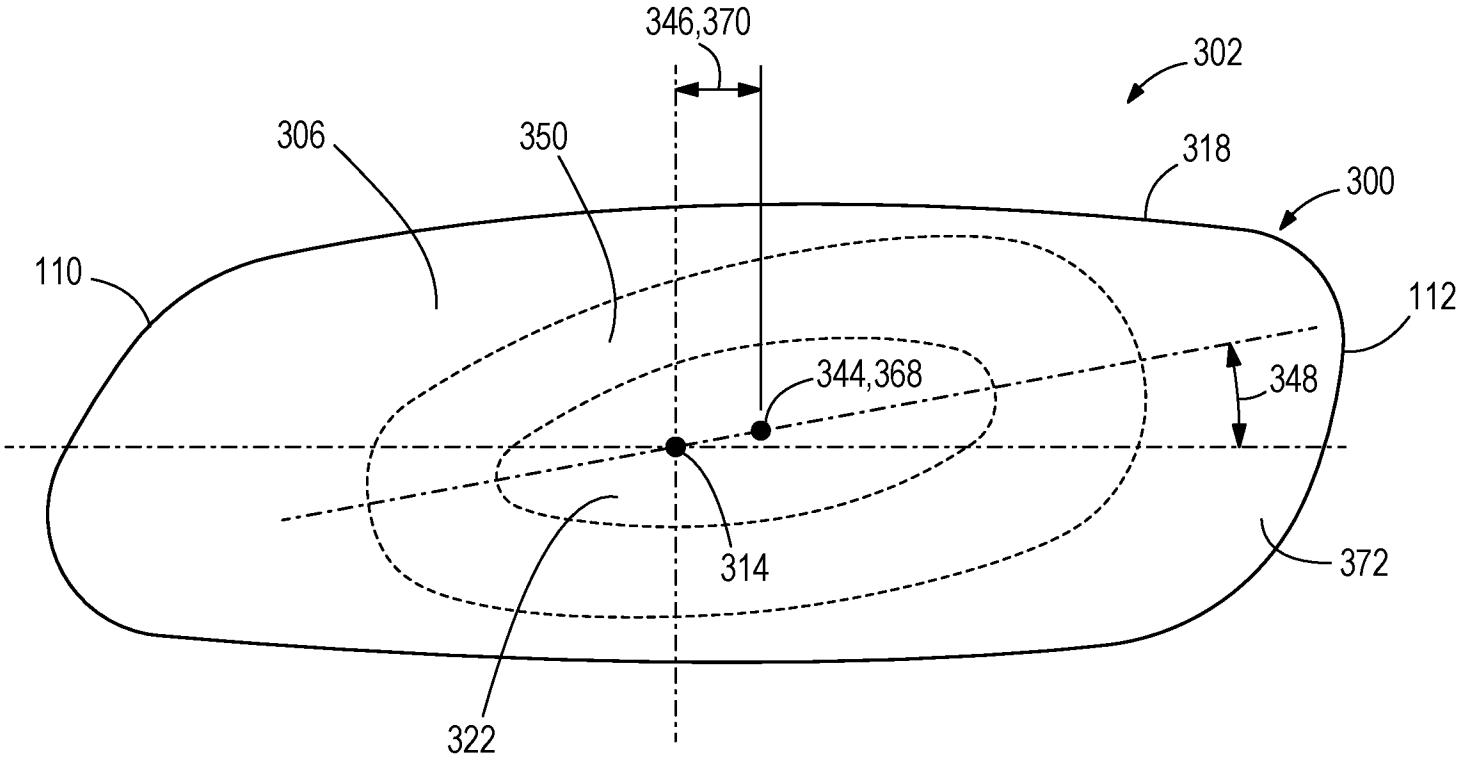
FIG. 11 illustrates a rear surface view of the club face comprising the variable thickness profile having the toe side width greater than the heel side width of FIG. 9.

FIGS. 9-11 illustrates the second embodiment comprising a club face 302 for a wood-type club head 300. The club head 300 can be similar to the club head 100 described above. The club face 302 can be similar to the club face 102 described above. The club face 302 comprises a striking surface 306 for impacting a golf ball, and a rear surface 310 opposite the striking surface 306. The club face 302 comprises a variable thickness profile extending between a face center 314 and a face perimeter 318. The variable thickness profile of the club face 302 can taper from a thickened portion to a thinned portion to adjust stiffness and the characteristic time.

Specifically, as illustrated in FIG. 9, the variable thickness profile of club face 302 includes a center region 322, a transition region 350, and a perimeter region 372. The center region 322 encompasses the face center 314 of the club face 302. The center region 322 comprises a center thickness 326 that can be constant. In many embodiments, the center region 322 comprises a maximum thickness of the club face 302. The center region 322 can comprise an elliptical shape, oblong-ellipse shape, egg shape, or ellipse with circular ends shape when viewing the rear surface 310 of the club face 302.

The center thickness 326 can be less than or equal to 0.15 inch, less than or equal to 0.10 inch, less than or equal to 0.09 inch, or less than or equal to 0.08 inch. In other embodiments, the center thickness 226 can range from 0.05 to 0.10 inch. In other embodiments, the center thickness 226 can range from 0.05 to 0.075 inch, or 0.075 to 0.10 inch. For example, the center thickness 226 can be 0.05, 0.06, 0.065, 0.07, 0.075, 0.078, 0.08, 0.081, 0.085, 0.09, 0.095, or 0.10 inch. In one example, the center thickness 226 can be 0.075 inch.

The center region 322 further comprises a perimeter edge 328 including a toe edge 330, a heel edge 332 opposite the toe edge 330, a top edge 334, and a bottom edge 336 opposite the top edge 334. The toe edge 330 is located toward the toe from the face center 314, the heel edge 332 is located toward the heel from the face center 314, the top edge 334 is located toward the crown from the face center 314, and the bottom edge 336 is located toward the sole from the face center 314. The top edge 334 and the bottom edge 336 of the perimeter edge 328 comprise an elliptical curved edge or an elliptical shaped edge. The toe edge 330 and the heel edge 332 of the perimeter edge 328 comprise a circular shaped edge.

The top edge 334 and the bottom edge 336 comprise a curved edge formed from a portion of an ellipse. The top edge 334 and the bottom edge 336 comprise a radius of curvature ranging from 1.0 to 2.5 inches. In other embodiments, the radius of curvature of the top edge 334 and the bottom edge 336 can range from 1.0 to 1.8 inches, or 1.8 to 2.5 inches. For example, radius of curvature of the top edge 334 and the bottom edge 336 can be 1.0, 1.1, 1.2, 1.3, 1.4, 1.5, 1.6, 1.7, 1.8, 1.9, 2.0, 2.1, 2.2, 2.3, 2.4, or 2.5 inches. In one example, the radius of curvature of the top edge 334 and the bottom edge 336 can be 1.2 inch.

Referring to FIG. 9, the toe edge 330 of the center region 322 can comprise a curved edge formed from a portion of a circle. In other words, when viewing the rear surface 310 of the club face 302, the toe edge 330 can be formed from a boundary of a half circle having a diameter. The center region 322 comprises a toe side width 338 measured at the toe edge 330, wherein the toe side width 338 is measured at the locations where the perimeter edge 328 deviates from an elliptical shaped edge and where the perimeter edge 328 begins to form a circular shaped edge. In many embodiments, the toe side width 338 of the center region 322 can be measured as the diameter of the circle. In many embodiments, the toe side width 338 of the center region 322 can range from 0.1 to 0.5 inch. In other embodiments, the toe side width 338 of the center region 322 can range from 0.1 to 0.25 inch, or 0.25 to 0.5 inch. For example, the toe side width 338 of the center region 322 can be 0.1, 0.15, 0.2, 0.225, 0.25, 0.3, 0.35, 0.4, 0.45, or 0.5 inch. In one example, the toe side width 338 of the center region 322 can be 0.225 inch.

The heel edge 332 of the center region 322 can be formed similar to the toe edge 330 of the center region 322, but comprise a smaller heel side width 340 (i.e. the heel edge 332 of the center region 322 can comprise a curved edge formed from a portion of a circle having a diameter). The toe side width 338 of the center region 322 is greater than the heel side width 340 of the center region 322. The heel side width 340 of the center region 322 is less than the toe side width 338 of the center region 322. The heel side width 340 is measured at the heel edge 332, wherein the heel side width 340 is measured at the locations where the perimeter edge 328 deviates from an elliptical shaped edge and where the perimeter edge 328 begins to form a circular shaped edge. In many embodiments, the heel side width 340 of the center region 322 can be measured as the diameter of the circle. In many embodiments, the heel side width 340 of the center region 322 can range from 0.05 to 0.35 inch. In other embodiments, the heel side width 340 of the center region 322 can range from 0.05 to 0.25 inch, or 0.25 to 0.35 inch. For example, the heel side width 340 of the center region 322 can be 0.05, 0.1, 0.15, 0.16, 0.17, 0.18, 0.19, 0.2, 0.21, 0.22, 0.23, 0.24, 0.25, 0.3, or 0.35 inch. In one example, the heel side width 340 of the center region 322 can be 0.15 inch.

Further, the center region 322 can comprise a length 342. The length 342 of the center region 322 is measured from a heelmost point of the center region 322 to a toemost point of the center region 322 in a direction extending from the heel to the toe parallel to the x-axis 136. In many embodiments, the length 342 of the center region 322 can range from 0.8 to 1.6 inch. In other embodiments, the length 342 of the center region 322 can range from 0.8 to 1.3 inch, 0.9 to 1.4 inch, 1.0 to 1.5 inch, or 1.1 to 1.6 inch. For example, the length 342 of the center region 322 can be 0.8, 0.9, 1.0, 1.1, 1.15, 1.16, 1.17, 1.18, 1.19, 1.2, 1.3, 1.4, 1.5, or 1.6 inch. In one example, the length 342 of the center region 322 can be approximately 1.19 inch.

Further, as illustrated in FIG. 11, the center region 322 can encompass a center region center 344 that is offset from the face center 314 by an offset distance 346. It would be appreciated that FIG. 11 illustrates an exaggerated view of the offset distance to help improve understanding of the second embodiment. In many embodiments, the center region center 344 can be offset from the face center 314 in a direction toward the crown, the sole, and/or the toe. Described another way, the center region center 344 can be offset from the x-axis 136 in a direction toward the crown or the sole. Further, described another way, the center region center 344 can be offset from the y-axis 138 in a direction toward the toe. As illustrated in FIG. 11, the center region center 344 can be offset in a direction toward the toe and/or crown.

The offset distance 346 can be measured in a direction extending from the face center 314 to the center region center 344 parallel to the x-axis 136. In many embodiments, the offset distance 346 can range from greater than 0 inch to 0.2 inch. In other embodiments, the offset distance 346 can range from greater than 0 to 0.1 inch, or 0.1 to 0.2 inch. In other embodiments, the offset distance 346 can range from greater than 0 to 0.05 inch, 0.05 to 0.1 inch, 0.1 to 0.15, or 0.15 to 0.2 inch. For example, the offset distance 346 can be 0.04, 0.05, 0.055, 0.06, 0.07, 0.08, 0.09, 0.1, 0.15, 0.16, 0.17, 0.18, 0.19, or 0.2 inch. In one example, the offset distance 346 can be 0.05 inch.

Further, as illustrated in FIG. 11, the center region center 344 can be offset from face center 314 at an offset angle 348 to the x-axis 136. It would be appreciated that FIG. 11 illustrates an exaggerated view of the offset angle to help improve understanding of the second embodiment. The offset angle 348 of the center region center 344 can be measured between the x-axis 136 and a line extending through the face center 314 and the center region center 344 (i.e. a line extending radially or in a direction a radius from the face center 314). In many embodiments, the offset angle 348 can range from 0 to 10 degrees. In other embodiments, the offset angle 348 can range from 0 to 5 degrees, or 5 to 10 degrees. In other embodiments still, the offset angle 348 can range from 0 to 8 degrees, 1 to 9 degrees, or 2 to 10 degrees. For example, the offset angle 348 can be 0, 0.5, 1, 1.5, 2, 2.5, 3, 3.5, 4, 5, 6, 7, 8, 9, or 10 degrees. In one example, the offset angle 348 can be 2.5 degrees.

Referring to FIGS. 9-11, the transition region 350 abuts or contacts the center region 322. The transition region 350 comprises a transition thickness that varies in a direction extending from the face center 314 to the face perimeter 318. In many embodiments, the transition thickness decreases or tapers in a direction extending from the face center 314 to the face perimeter 318. The transition region 350 can comprise one or more arcuate surfaces with one or more radius of curvature. The arcuate surfaces of the transition region 350 smoothly blend or gradually taper the club face 302 thickness between the center region 322 and the perimeter region 370. The transition region 350 can comprise an elliptical shape, oblong-ellipse shape, egg shape, or ellipse with circular ends shape when viewing the rear surface 310 of the club face 302.

The transition region 350 further comprises a perimeter edge 352 including a toe edge 354, a heel edge 356 opposite the toe edge 354, a top edge 358, and a bottom edge 360 opposite the top edge 358. The toe edge 354 is located toward the toe from the face center 314, the heel edge 356 is located toward the heel from the face center 314, the top edge 358 is located toward the crown from the face center 314, and the bottom edge 360 is located toward the sole from the face center 314. The perimeter edge 352 of the transition region 350 is offset and surrounds the perimeter edge 328 of the center region 322. The top edge 358 and the bottom edge 360 of the perimeter edge 352 comprise an elliptical curved edge or an elliptical shaped edge. The toe edge 354 and the heel edge 356 of the perimeter edge 352 comprise a circular shaped edge.

The top edge 358 and the bottom edge 360 comprise a curved edge formed from a portion of an ellipse. The top edge 358 and the bottom edge 360 comprise a radius of curvature ranging from 1.5 to 3.5 inches. In other embodiments, the radius of curvature of the top edge 358 and the bottom edge 360 can range from 1.5 to 2.5 inches, or 2.5 to 3.5 inches. For example, radius of curvature of the top edge 358 and the bottom edge 360 can be 1.5, 1.6, 1.7, 1.8, 1.9, 2.0, 2.1, 2.2, 2.3, 2.4, 2.5, 2.6, 2.7, 2.8, 2.9, 3.0, 3.1, 3.2, 3.3, 3.4, or 3.5 inches. In one example, the radius of curvature of the top edge 358 and the bottom edge 360 can be 2.4 inch.

The toe edge 354 of the transition region 350 can comprise a curved edge formed from a portion of a circle. In other words, when viewing the rear surface 310 of the club face 302, the toe edge 354 of the transition region 350 can be formed from a boundary of a half circle having a diameter. The transition region 350 comprises a toe side width 362 measured at the toe edge 354, wherein the toe side width 362 is measured at the locations where the perimeter edge 352 deviates from an elliptical shaped edge and where the perimeter edge 328 begins to form a circular shaped edge. In many embodiments, the toe side width 362 of the transition region 350 can be measured as the diameter of the circle. In many embodiments, the toe side width 362 of the transition region 350 can range from 0.5 to 1 inch. In other embodiments, the toe side width 362 of the transition region 350 can range from 0.5 to 0.75 inch, or 0.75 to 1 inch. For example, the toe side width 362 of the transition region 350 can be 0.5, 0.55, 0.6, 0.65, 0.7, 0.75, 0.8, 0.85, 0.9, 0.95, or 1 inch. In one example, the toe side width 362 of the transition region 350 can be 0.75 inch.

The heel edge 356 of the transition region 350 can be formed similar to the toe edge 354 of the transition region 350, but comprise a smaller heel side width 364 (i.e. the heel edge 356 of the transition region 350 can comprise a curved edge formed from a portion of a circle having a diameter). The toe side width 362 of the transition region 350 is greater than the heel side width 364 of the transition region 350. The heel side width 364 of the transition region 350 is less than the toe side width 362 of the transition region 350. The heel side width 364 is measured at the heel edge 356, wherein the heel side width 364 is measured at the location where the perimeter edge 352 deviates from an elliptical shaped edge and where the perimeter edge 352 begins to form a circular shaped edge. In many embodiments, the heel width 364 of the transition region 350 can be measured as the diameter of the circle. In many embodiments, the heel side width 364 of the transition region 350 can range from 0.25 to 0.75 inch. In other embodiments, the heel side width 364 of the transition region 350 can range from 0.25 to 0.5 inch, or 0.5 to 0.75 inch. For example, the heel side width 364 of the transition region 350 can be 0.25, 0.3, 0.35, 0.4, 0.45, 0.5, 0.55, 0.6, 0.65, 0.7, or 0.75 inch. In one example, the heel side width 364 of the transition region 350 can be 0.5 inch.

Further, the transition region 350 can comprise a length 366. The length 366 of the transition region 350 is measured from a heelmost point of the transition region 350 to a toemost point of the transition region 350 in a direction extending from the heel to the toe parallel to the x-axis 136. In many embodiments, the length 366 of the transition region 350 can range from 1.5 to 3.0 inch. In other embodiments, the length 366 of the transition region 350 can range from 1.5 to 2.5 inch, or 2.5 to 3.0 inch. For example, the length 366 of the transition region 350 can be 1.5, 1.6, 1.7, 1.8, 1.9, 1.95, 2.0, 2.1, 2.2, 2.3, 2.4, 2.5, 2.6, 2.7, 2.8, 2.9, or 3.0 inch. In one example, the length 366 of the transition region 350 can be approximately 1.9 inch.

Further, as illustrated in FIG. 11, the transition region 350 can encompass a transition region center 368 that is offset from the face center 314 by an offset distance 370. It would be appreciated that FIG. 11 illustrates an exaggerated view of the offset distance/angle to help improve understanding of the second embodiment. In many embodiments, the transition region center 368 can be offset from the face center 314 in a direction toward the crown, the sole, and/or the toe. Described another way, the transition region center 368 can be offset from the x-axis 136 in a direction toward the crown or the sole. Further, described another way, the transition region center 368 can be offset from the y-axis 138 in a direction toward the toe. As illustrated in FIG. 11, the transition region center 230 can be offset in a direction toward the toe and/or the crown. Further, the transition region center 368 can be offset at the same location as the center region center 344. In these embodiments, the transition region center 368 and center region center 344 can be at the same location/distance/angle with respect to the face center 314. In other embodiments, the transition region center 368 can be offset at a different location than the center region center 344. In these embodiments, the transition region center 368 and the center region center 344 are not at the same location/distance/angle with respect to the face center 314 of the club face 302.

Referring to FIGS. 9-11, the perimeter region 372 abuts or contacts the transition region 350. The perimeter region 372 further abuts or contacts the face perimeter 318. The perimeter region 372 surrounds the transition region 350 or is located between the transition region 350 and the face perimeter 318. The perimeter region 372 comprises a perimeter thickness 374 that can be constant. In many embodiments, the perimeter region 372 comprises a minimum thickness of the club face 302. The perimeter region 372 further comprises a peripheral thickness at the face perimeter 318 or measured at an edge of the club face 302 closest to the face perimeter 318. The peripheral thickness can be equal or different than the perimeter thickness.

The perimeter thickness 374 can be greater than or equal to 0.05 inch, greater than or equal to 0.06 inch, greater than or equal to 0.065 inch, greater than or equal to 0.07 inch, greater than or equal to 0.08 inch, or greater than or equal to 0.09 inch. In other embodiments, the perimeter thickness 374 can range from 0.05 to 0.10 inch. In some embodiments, the perimeter thickness 374 can range from 0.05 to 0.075 inch, or 0.075 to 0.10 inch. In some embodiments, the perimeter thickness 374 can range from 0.05 to 0.06 inch, 0.06 to 0.07 inch, 0.07 to 0.08 inch, 0.08 to 0.09 inch, or 0.09 to 0.10 inch. For example, the perimeter thickness 374 can be approximately 0.05, 0.055, 0.06, 0.063, 0.065, 0.07, 0.075, 0.08, 0.085, 0.09, 0.095, or 0.10 inch. In another example, the perimeter thickness 374 can be 0.06 inch.

The variable thickness profile of club face 302 reduces the characteristic time variability across the club face 302. Specifically, the thickened center region 322 is shifted and angled to increase the stiffness in the high toe area of the club face 302. Further, the toe side width (i.e. center region width and transition region width) of the variable thickness profile is greater than the heel side width of the variable thickness profile to further increase the stiffness in the high toe area of the club face 302. Increasing stiffness in the high toe area of the club face 302 decreases the characteristic time. Further, the thinned perimeter region 372 decreases the stiffness in the heel area of the club face 302 to increase the characteristic time. The variable thickness profile of club face 302 reduces characteristic time variability across the club face 202 and allows the characteristic time values to not deviate greatly from the characteristic time at the face center 314. Further, the variable thickness profile of the club face 302 allows the characteristic time values to not deviate greatly between measurement locations at the heel area and high toe area of the club face 302.

For example, the characteristic time at a first reference point 150 along the horizontal x-axis 136 at approximately a 10 mm offset from the face center 128 in a direction toward the heel deviates less than 10 μs from the characteristic time at the face center 314. In another example, the characteristic time at a second reference point 154 along the horizontal x-axis 136 at approximately a 10 mm offset from the face center 314 in a direction toward the toe deviates less than 10 μs from the characteristic time at the face center 314. In another example, the characteristic time at a first reference point 150 along the horizontal x-axis 136 at approximately a 20 mm offset from the face center 314 in a direction toward the toe deviate less than 10 μs from the characteristic time at the face center 314. Characteristic time values that deviate less than 10 μs provide consistent ball performance for center and off-center hits.

Third Embodiment of a Club Face Variable Thickness Profile

Described below is a third embodiment of the present design that increases high toe stiffness and decreases heel stiffness. The third embodiment achieves this stiffness profile by comprising a variable thickness profile having a perimeter region with a thickened portion and a thinned portion (i.e. a perimeter region with a variable thickness). The perimeter region comprises a large percentage of the striking surface area, wherein the thickened portion comprises a large percentage of the high toe and top areas of the striking surface, and the thinned portion comprises a large percentage of the heel and bottom areas of the striking surface. The third embodiment further comprises a center region to increase stiffness at the face center.

With reference to the quadrant system, the thickened portion of the perimeter region comprises a majority of the high toe and top area of the striking surface within the high toe quadrant 160. The thinned portion of the perimeter region comprises a majority of the heel area of the striking surface within the low heel quadrant 166. The large thickened portion of the perimeter region increases stiffness in the high toe area of the club face. The large thinned portion of the perimeter region decreases stiffness in the heel area of the striking surface. The third embodiment decreases CT values in the high toe area and increases CT values in the heel area thereby reducing the gap between CT for measurement locations across the club face.

Figure 12:
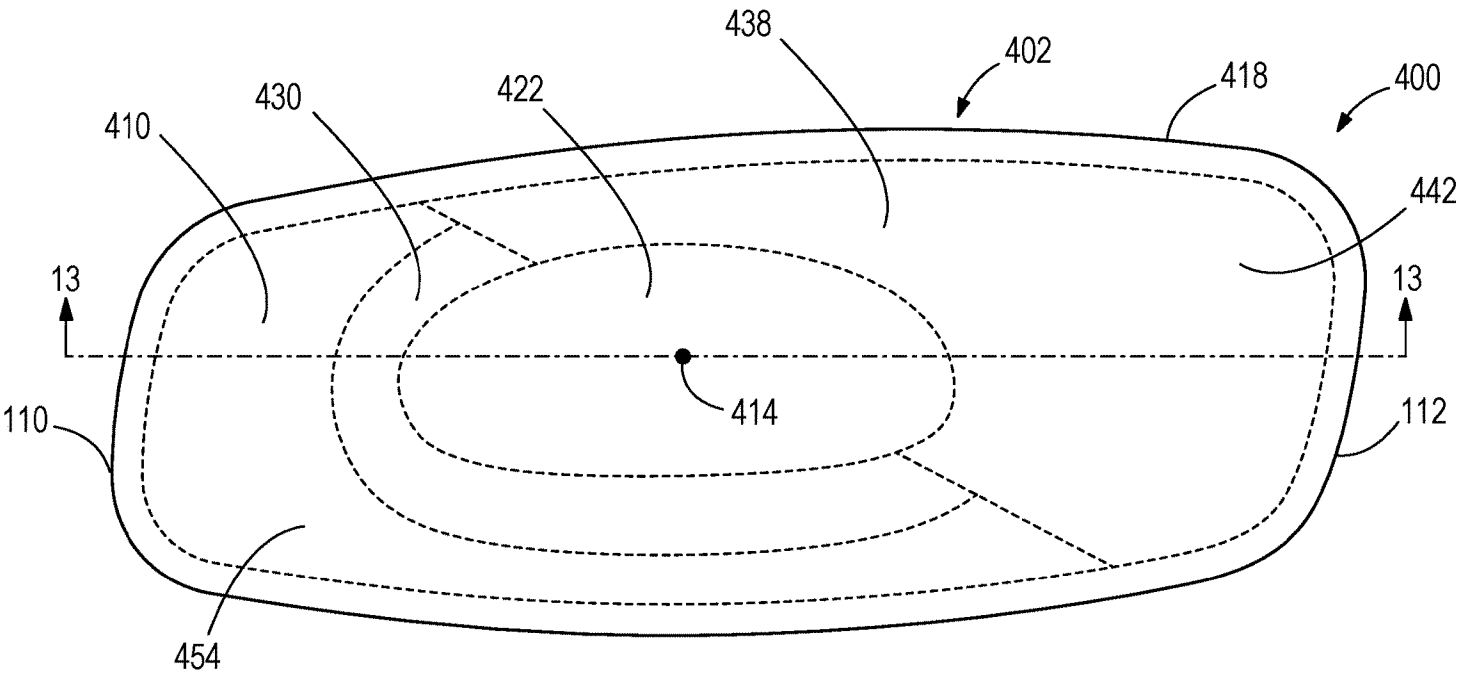
FIG. 12 illustrates a rear surface view of a club face comprising a variable thickness profile having a perimeter region comprising a thickened portion and a thinned portion.
Figure 13:
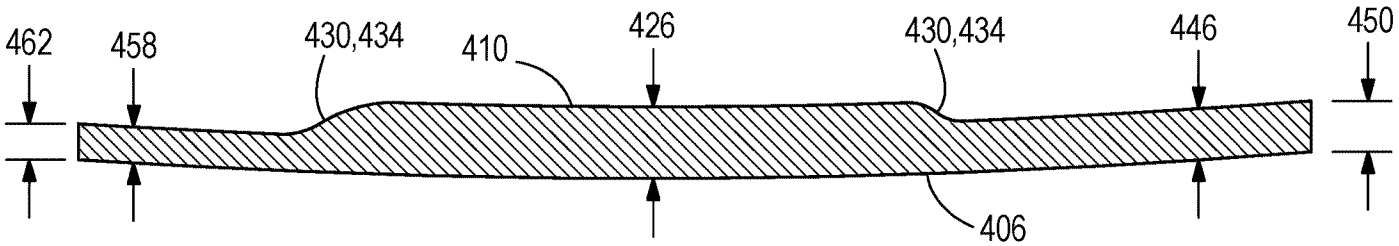
FIG. 13 illustrates a cross sectional view of the club face of FIG. 12 taken at line 13-13.

FIGS. 12 and 13 illustrate the third embodiment a club face 402 for a wood-type club head 400. The club head 400 can be similar to the club head 100 described above. The club face 402 can be similar to the club face 102 described above. The club face 402 comprises a striking surface 406 for impacting a golf ball, and a rear surface 410 opposite the striking surface 406. The club face 402 comprises a variable thickness profile extending between a face center 414 and a face perimeter 418. The variable thickness profile of the club face 402 can taper from a thickened portion to a thinned portion to adjust stiffness and the characteristic time.

Specifically, as illustrated in FIGS. 12 and 13, the variable thickness profile of club face 402 includes a center region 422, a transition region 430, and a perimeter region 438 including a thickened portion 442 and a thinned portion 454. The center region 422 encompasses the face center 414 of the club face 402. The center region 422 comprises a center thickness 426 that can be constant. In many embodiments, the center region 422 comprises a maximum thickness of the club face 402. The center region 322 can comprise an elliptical, oblong-ellipse, or egg shape when viewing the rear surface 410 of the club face 402.

The center thickness 426 can be less than or equal to 0.15 inch, less than or equal to 0.10 inch, less than or equal to 0.09 inch, or less than or equal to 0.08 inch. In other embodiments, the center thickness 426 can range from 0.05 to 0.10 inch. In other embodiments, the center thickness 426 can range from 0.05 to 0.075 inch, or 0.075 to 0.10 inch. For example, the center thickness 426 can be 0.05, 0.06, 0.065, 0.07, 0.075, 0.078, 0.08, 0.081, 0.085, 0.09, 0.095, or 0.10 inch. In one example, the center thickness 426 can be 0.081 inch.

The transition region 430 abuts or contacts the center region 422. The transition region 430 surrounds the center region 422. The transition region 430 comprises a transition thickness that varies in a direction extending from the face center 414 to the face perimeter 418. In many embodiments, the transition thickness decreases or tapers in a direction extending from the face center 414 to the face perimeter 418. The transition region 430 can comprise one or more arcuate surfaces 434. The arcuate surfaces of the transition region 430 smoothly blend or gradually taper the club face 402 thickness between the center region 422 and the perimeter region 438. In one example, the transition region 430 can comprise a first arcuate surface including a first radius of curvature, and a second arcuate surface including a second radius of curvature. The first arcuate surface abuts or contacts the center region 422 and the second arcuate surface abuts or contacts the perimeter region 438. The first arcuate surface can be convex when viewed normal to the rear surface 410 of the club face 402, and the second arcuate surface can be concave when viewed normal to the rear surface 410 of the club face 402.

The perimeter region 438 abuts or contacts the transition region 430. The perimeter region 438 further abuts or contacts the face perimeter 418. The perimeter region 438 surrounds the transition region 430 or is located between the transition region 430 and the face perimeter 418. The perimeter region 438 can further include a thickened portion 442 including a thickened thickness 446 and a thinned portion 454 including a thinned thickness 458. In many embodiments, as illustrated in FIG. 12, the thickened portion 442 of the perimeter region 438 can be located at the toe, low toe, and/or high toe area of the club face 402. In many embodiments, the thinned portion 454 of the perimeter region 438 can be located at the heel, low heel, and/or high heel area of the club face 402. Further, the thickened portion 442 of the perimeter region 438 can further extend along the top area towards the high heel area of the club face 402, and the thinned portion 454 of the perimeter region 438 can extend along the bottom area towards the low toe area of the club face 402.

With reference to the quadrant system, the thickened portion 442 of the perimeter region 438 can be located within the high toe quadrant 160, the low toe quadrant 162, and/or the high heel quadrant 164. The thinned portion 454 of the perimeter region 438 can be located within the low heel quadrant 166, the high heel quadrant 164, and/or the low toe quadrant 162. The thickened portion 442 of the perimeter region 438 comprises a large percentage of the striking surface area within the high toe quadrant 160 to increase high toe stiffness. The thinned portion 454 of the perimeter region 438 comprises a large percentage of the striking surface area within the low heel quadrant 166 to decrease heel stiffness.

The thickened portion 442 of the perimeter region 438 can comprise a percentage of the striking surface area. The thickened portion 442 can comprise greater than 30%, 35%, 40%, 45%, 50%, 55%, 60%, 65%, or 70% of the striking surface area. In other embodiments, the thickened portion 442 can comprise 30 to 75% of the striking surface area. In other embodiments, the thickened portion 442 can comprise 30 to 50%, or 50% to 75% of the striking surface area. In other embodiments still, the thickened portion 442 can comprise 30 to 55%, 40 to 65%, or 50 to 75% of the striking surface area. For example, the thickened portion 442 can comprise 30, 35, 40, 45, 50, 55, 60, 65, 70, or 75% of the striking surface area.

The thinned portion 454 of the perimeter region 438 can comprise a percentage of the striking surface area. The thinned portion 454 can comprise less than 45, 40, 35, 30, 25, or 20% of the striking surface area. In other embodiments, the thinned portion 454 can comprise 15 to 45% of the striking surface area. In other embodiments, the thinned portion 454 can comprise 15 to 30%, or 30 to 45% of the striking surface area. In other embodiments still, the thinned portion 454 can comprise 15 to 35%, or 20 to 45% of the striking surface area. For example, the thinned portion 454 can comprise 15, 20, 25, 30, 35, 40, or 45% of the striking surface area.

The thickened portion 442 of the perimeter region 438 can partially surround the transition region 430. The thickened portion 442 comprises a thickened thickness 446 less than the center thickness 426, but greater than the thinned thickness 458. The thickened thickness 446 is constant within the thickened portion 442. The thickened portion 442 further comprises a thickened peripheral thickness 450 at the face perimeter 418 or measured at an edge of the club face 402 closest to the face perimeter 418. The thickened peripheral thickness 450 can be equal or different than the thickened thickness 446 of the thickened portion 442.

The thickened thickness 446 of the thickened portion 442 can be greater than or equal to 0.05 inch, greater than or equal to 0.06 inch, greater than or equal to 0.065 inch, greater than or equal to 0.07 inch, greater than or equal to 0.08 inch, or greater than or equal to 0.09 inch. In other embodiments, the thickened thickness 446 can range from 0.05 to 0.10 inch. In some embodiments, the thickened thickness 446 can range from 0.05 to 0.075 inch, or 0.075 to 0.10 inch. In some embodiments, the thickened thickness 446 can range from 0.05 to 0.06 inch, 0.06 to 0.07 inch, 0.07 to 0.08 inch, 0.08 to 0.09 inch, or 0.09 to 0.10 inch. For example, the thickened thickness 446 can be approximately 0.05, 0.055, 0.06, 0.063, 0.065, 0.07, 0.075, 0.08, 0.085, 0.09, 0.095, or 0.10 inch. In one example, the thickened thickness 446 can be 0.078 inch.

The thinned portion 454 of the perimeter region 438 can partially surround the transition region 430. The thinned portion 454 comprises a thinned thickness 458 less than both the center thickness 426 and the thickened thickness 446. The thinned thickness 458 is constant within the thinned portion 454. In many embodiments, the thinned portion 454 comprises a minimum thickness of the club face 402. The thinned portion 454 further comprises a thinned peripheral thickness 462 at the face perimeter 418 or measured at an edge of the club face 402 closest to the face perimeter 418. The thinned peripheral thickness 462 can be equal or different than the thinned thickness 458 of the thinned portion 454.

The thinned thickness 458 of the thinned portion 454 can be greater than or equal to 0.05 inch, greater than or equal to 0.06 inch, greater than or equal to 0.065 inch, greater than or equal to 0.07 inch, greater than or equal to 0.08 inch, or greater than or equal to 0.09 inch. In other embodiments, the thinned thickness 458 can range from 0.05 to 0.10 inch. In some embodiments, the thinned thickness 458 can range from 0.05 to 0.075 inch, or 0.075 to 0.10 inch. In some embodiments, the thinned thickness 458 can range from 0.05 to 0.06 inch, 0.06 to 0.07 inch, 0.07 to 0.08 inch, 0.08 to 0.09 inch, or 0.09 to 0.10 inch. For example, the thinned thickness 458 can be approximately 0.05, 0.055, 0.06, 0.063, 0.065, 0.07, 0.075, 0.08, 0.085, 0.09, 0.095, or 0.10 inch. In another example, the thinned thickness 458 can be 0.069 inch.

The variable thickness profile of club face 402 reduces the characteristic time variability across the club face 402. Generally, a club face experiences high characteristic time in the high toe area of the club face, and low characteristic time in the heel area of the club face. The club face 402 addresses the high characteristic time variability across the club face. Specifically, the center region 422 and the thickened portion 442 of the perimeter region 438 increase the stiffness in the high toe area of the club face 402. Increasing stiffness in the high toe area of the club face 402 decreases the characteristic time. Further, the thinned portion 454 of the perimeter region 438 decreases the stiffness in the heel area of the club face 402 to increase the characteristic time. Adjusting the stiffness of the club face 402 brings the characteristic time values closer together and reduces large gaps in characteristic time. The variable thickness profile of club face 402 reduces characteristic time variability across the club face 402 and allows the characteristic time values to not deviate greatly from the characteristic time at the face center 414.

Fourth Embodiment of a Club Face Variable Thickness Profile

Described below is a fourth embodiment of the present design that increases high toe stiffness and decreases heel stiffness. The fourth embodiment achieves this stiffness profile by comprising a variable thickness profile having a large thickened region and a large thinned region. The thickened region comprises a constant, maximum thickness that encompasses a face center and the high toe area of the club face. The thickened region extends from the center area of the club face to the toe area of the club face. The thickened region encompasses the face center and extends toward toe area of the club face. The thinned region is offset from the face center and extends toward the heel area of the club face. The thinned region comprises a constant, minimum thickness of the club face. The fourth embodiment is devoid of a separate center region that comprises a thickness greater than the other regions of the club face.

With reference to the quadrant system, the thickened region comprises the entire the high toe area of the club face within the high toe quadrant 160. The thinned region comprises a majority of the heel and low heel areas of the club face within the high heel quadrant 164 and the low heel quadrant 166. The large thickened region increases stiffness in the high toe area of the club face. The large thinned region decreases stiffness in the heel area of the club face. The fourth embodiment decreases CT values in the high toe area and increases CT values in the heel area thereby reducing the gap between CT for measurement locations across the club face.

Figure 14:
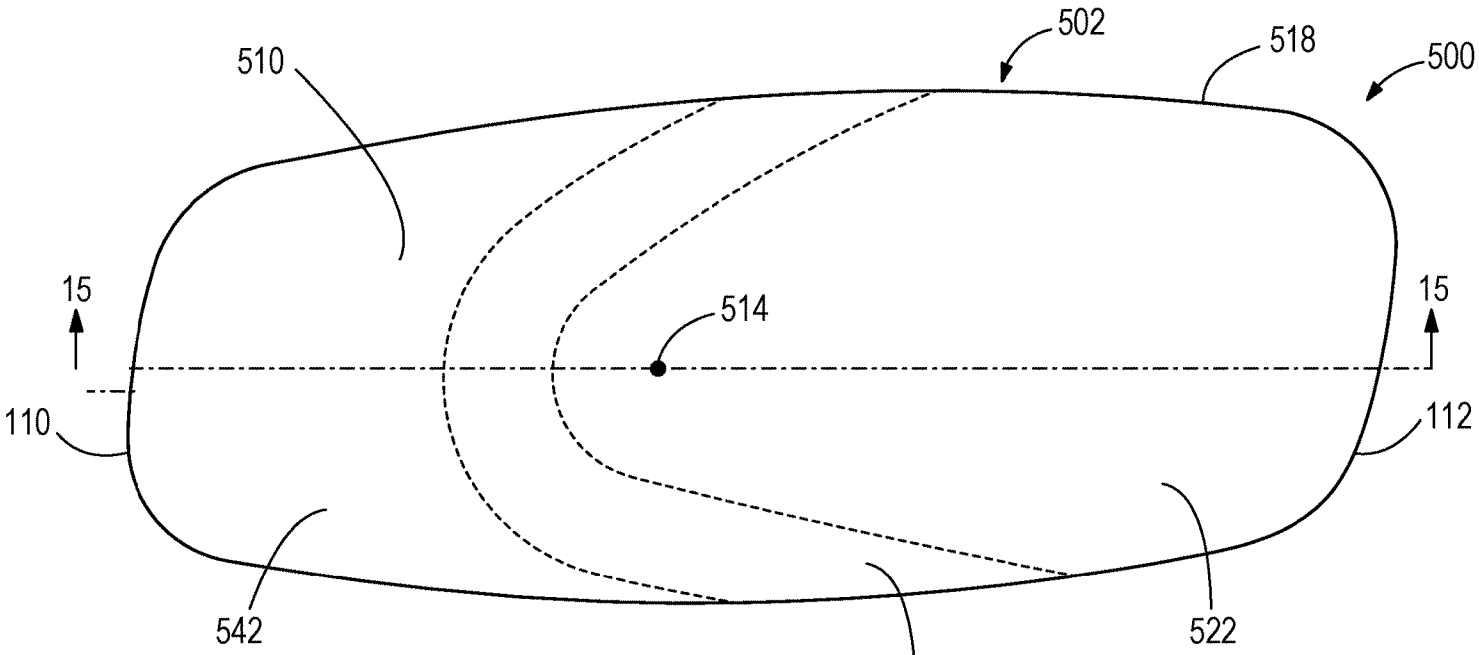
FIG. 14 illustrates a rear surface view of a club face comprising a variable thickness profile having a constant thickened region encompassing a face center and extending toward a toe area of the club face, and a thinned region extending toward a heel area of the club face.
Figure 15:
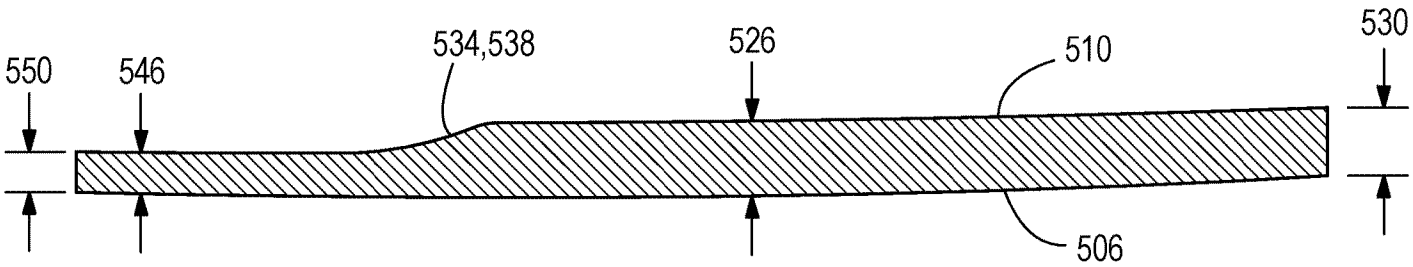
FIG. 15 illustrates a cross sectional view of the club face of FIG. 14 taken at line 15-15.

FIGS. 14 and 15 illustrate the fourth embodiment of a club face 502 for a wood-type club head 500. The club head 500 can be similar to the club head 100 described above. The club face 502 can be similar to the club face 102 described above. The club face 502 comprises a striking surface 506 for impacting a golf ball, and a rear surface 510 opposite the striking surface 506. The club face 502 comprises a variable thickness profile extending between a face center 514 and a face perimeter 518. The variable thickness profile of the club face 502 can taper from a thickened portion to a thinned portion to adjust stiffness and the characteristic time.

Specifically, as illustrated in FIGS. 14 and 15, the variable thickness profile of club face 502 includes a thickened region 522, a transition region 534, and a thinned region 542. The thickened region 422 encompasses the face center 514 of the club face 502. In many embodiments, the thickened region 522 can be located at the toe, high toe, and low toe areas of the club face 502. In many embodiments, the thinned region 542 can be located at the heel, high heel, and low heel areas of the club face 502.

With reference to the quadrant system, the thickened region 522 can be located within the high toe quadrant 160 and the low toe quadrant 162. The thinned region 542 can be located within the high heel quadrant 164 and the low heel quadrant 166. The thickened region 522 comprises the entire high toe area of the club face 502 within the high toe quadrant 160 to increase high toe stiffness. The thinned region 542 comprises a majority of the heel area of the club face 502 within the high heel quadrant 164 and the low heel quadrant 166 to decrease heel stiffness.

The thickened region 522 can comprise a percentage of the striking surface area. The thickened region 522 can comprise greater than 30%, 35%, 40%, 45%, 50%, 55%, 60%, 65%, or 70% of the striking surface area. In other embodiments, the thickened region 522 can comprise 30 to 75% of the striking surface area. In other embodiments, the thickened region 522 can comprise 30 to 50%, or 50% to 75% of the striking surface area. In other embodiments still, the thickened region 522 can comprise 30 to 55%, 40 to 65%, or 50 to 75% of the striking surface area. For example, the thickened region 522 can comprise 30, 35, 40, 45, 50, 55, 60, 65, 70, or 75% of the striking surface area.

The thinned region 542 can comprise a percentage of the striking surface area. The thinned region 542 can comprise less than 45, 40, 35, 30, 25, or 20% of the striking surface area. In other embodiments, the thinned region 542 can comprise 15 to 45% of the striking surface area. In other embodiments, the thinned region 542 can comprise 15 to 30%, or 30 to 45% of the striking surface area. In other embodiments still, the thinned region 542 can comprise 15 to 35%, or 20 to 45% of the striking surface area. For example, the thinned region 542 can comprise 15, 20, 25, 30, 35, 40, or 45% of the striking surface area.

The thickened region 522 abuts or contacts the face perimeter 518. The thickened region 522 comprises a thickened thickness 526 that can be constant. In many embodiments, the thickened region 522 comprises a maximum thickness of the club face 502. The thickened region 522 further comprises a thickened peripheral thickness 530 at the face perimeter 518 or measured at an edge of the club face 502 closest to the face perimeter 518. The thickened peripheral thickness 530 can be equal or different than the thickened thickness 526 of the thickened region 522.

The thickened thickness 526 of the thickened region 522 can be greater than or equal to 0.05 inch, greater than or equal to 0.06 inch, greater than or equal to 0.065 inch, greater than or equal to 0.07 inch, greater than or equal to 0.08 inch, or greater than or equal to 0.09 inch. In other embodiments, the thickened thickness 526 can range from 0.05 to 0.10 inch. In some embodiments, the thickened thickness 526 can range from 0.05 to 0.075 inch, or 0.075 to 0.10 inch. In some embodiments, the thickened thickness 526 can range from 0.05 to 0.06 inch, 0.06 to 0.07 inch, 0.07 to 0.08 inch, 0.08 to 0.09 inch, or 0.09 to 0.10 inch. For example, the thickened thickness 526 can be approximately 0.05, 0.055, 0.06, 0.063, 0.065, 0.07, 0.075, 0.08, 0.085, 0.09, 0.095, or 0.10 inch. In one example, the thickened thickness 526 can be 0.078 inch.

The transition region 534 abuts or contacts the thickened region 522. The transition region 534 abuts or contacts the face perimeter 518. The transition region 534 is between the thickened region 522 and the thinned region 5424. The transition region 534 can extend from a top of the face perimeter 518 to a bottom of the face perimeter 518. The transition region 534 comprises a transition thickness that varies in a direction extending from heel to the toe. In many embodiments, the transition thickness decreases or tapers in a direction extending from the toe to the heel. In other words, the transition thickness increases or ramps up in a direction extending from the heel to the toe. The transition region 534 can comprise one or more arcuate surfaces 538. The arcuate surfaces of the transition region 534 smoothly blend or gradually taper the club face 502 thickness between the thickened region 522 and the thinned region 542. In one example, the transition region 534 can comprise a first arcuate surface including a first radius of curvature, and a second arcuate surface including a second radius of curvature. The first arcuate surface abuts or contacts the thickened region 522 and the second arcuate surface abuts or contacts the thinned region 542. The first arcuate surface can be convex when viewed normal to the rear surface 510 of the club face 502, and the second arcuate surface can be concave when viewed normal to the rear surface 510 of the club face 502.

The thinned region 542 abuts or contacts the transition region 534. The thinned region 542 further abuts or contacts the face perimeter 518. The thinned region 542 can partially surround the transition region 534. The thinned region 542 comprises a thinned thickness 546 is constant. The thinned thickness 546 is less than the thickened thickness 526. In many embodiments, the thinned region 522 comprises a minimum thickness of the club face 502. The thinned region 542 further comprises a thinned peripheral thickness 550 at the face perimeter 518 or measured at an edge of the club face 502 closest to the face perimeter 518. The thinned peripheral thickness 550 can be equal or different than the thinned thickness 546 of the thinned region 542.

The thinned thickness 546 of the thinned region 542 can be greater than or equal to 0.05 inch, greater than or equal to 0.06 inch, greater than or equal to 0.065 inch, greater than or equal to 0.07 inch, greater than or equal to 0.08 inch, or greater than or equal to 0.09 inch. In other embodiments, thinned thickness 546 can range from 0.05 to 0.075 inch, or 0.075 to 0.10 inch. In some embodiments, the thinned thickness 546 can range from 0.05 to 0.06 inch, 0.06 to 0.07 inch, 0.07 to 0.08 inch, 0.08 to 0.09 inch, or 0.09 to 0.10 inch. For example, the thinned thickness 546 can be approximately 0.05, 0.055, 0.06, 0.063, 0.065, 0.07, 0.075, 0.08, 0.085, 0.09, 0.095, or 0.10 inch. In one example, the thickened thickness 526 can be 0.069 inch.

The variable thickness profile of club face 502 reduces the characteristic time variability across the club face 502. Generally, a club face experiences high characteristic time in the toe or high toe area of the club face, and low characteristic time in the heel area of the club face. The club face 502 addresses the high characteristic time variability across the club face. Specifically, the thickened region 522 of club face 502 increases the stiffness in the center and high toe area of the club face 502. Increasing stiffness in the center and high toe area of the club face 502 decreases the characteristic time. Further, the thinned region 542 of the club face 502 decreases the stiffness in the heel area of the club face 502. Decreasing stiffness in the heel area of the club face 502 increases the characteristic time. Adjusting the stiffness of the club face 502 can bring the characteristic time values closer together and reduce large gaps in characteristic time. The variable thickness profile of club face 502 reduces characteristic time variability across the club face 502 and allows the characteristic time values to not deviate greatly from the characteristic time at the face center 514.

Center of Gravity and Moment of Inertia Properties

The club heads and the club faces described in this disclosure provide a means for controlling or balancing the CT variability across the club face. The variable thickness profiles described above allow for more consistent CT values for locations at the toe, center, and heel area of the club face. Reducing CT variability across the club face allows the club head to provide consistent ball speed for center and off center hits. The disclosed club head further balances the CT variability to meet the United States Golf Association (USGA) regulation of less than 257 microseconds (i.e. nominal value of 239 microseconds with a 18 microsecond tolerance).

CT considerations often add more weight to the front of the club head which can negatively impact center of gravity (CG) and moment of inertia (MOI) properties. However, the club heads and club faces described in this disclosure can further comprise a beneficial center of gravity location and increased moment of inertia properties. The club faces described in this disclosure can be combined with a club head with a low and rear center of gravity position. The club faces described in this disclosure can be further be combined with a high forgiving club head comprising a high moment inertia Ixx and Iyy. The club faces that balance CT combined with the club head with a low and rear center of gravity position and high forgiveness provide club heads with improved feel and playability.

To achieve beneficial center of gravity position and high moment of inertia properties, the club head 100 can further comprise structures that affect the mass properties of the club head 100 such as removable weights, thinned crown, and/or lightweight crown formed from a non-metal material. These structures allow for adjustments to the mass properties to achieve a low and rear CG position and high moment of inertia properties. These structures allow for weight adjustments or weight savings that can be combined with the club heads and club faces that provide consistent CT across the club face. Described below are center of gravity locations that provide a low and rear CG position, and moment of inertia properties that achieve a high forgiveness.

As described above and with reference to FIGS. 2-5, the center of gravity (CG) is located with the coordinate system defined at the face center 128 having the x-axis 136, the y-axis 138, and the z-axis 140. The x-axis 136 extends in a positive direction toward the heel 110. The y-axis extends in a positive direction toward the crown 106. The z-axis 140 extends in a positive direction toward the rear 116.

For drivers, the CG 142 comprises an x-axis 136 location ranging between −2 mm to 6 mm. In other embodiments, the CG 142 comprises an x-axis location −2 mm to 2 mm, or 2 mm to 6 mm. For example, the CG 142 comprises an x-axis 136 location at −2, −1.5, −1, 0, 1, 1.5, 2, 2.5, 3, 3.5, 4, 4.5, 5, 5.5, or 6 mm.

For fairway woods, the CG 142 comprises an x-axis 136 location ranging between −7 mm to 1 mm. In other embodiments, the CG 142 comprises an x-axis 136 location ranging between −7 mm to −3 mm, or −3 mm to 1 mm. For example, the CG 142 comprises an x-axis 136 location at −7, −6, −5, −4, −3, −2, −1, 0, 0.5, or 1 mm.

For hybrids, the CG 142 comprises an x-axis 136 location ranging between −5 mm to 2 mm. In other embodiments, the CG 142 comprises an x-axis 136 location ranging between −5 mm to −1 mm, or −1 mm to 2 mm. In other embodiments still, the CG 142 comprises an x-axis 136 location ranging between −4 mm to 0 mm, −3 mm to 1 mm, or −2 mm to 2 mm. For example, the CG 142 comprises an x-axis 136 location at −5, −4, −3, −2.5, −2, −1.5, −1, −0.5, 0, 0.5, 1, 1.5, or 2 mm.

For drivers, the CG 142 comprises a y-axis 138 location ranging between −4 mm to −10 mm. In other embodiments, the CG 142 comprises a y-axis 138 location ranging between −4 to −7 mm, or −7 mm to −10 mm. For example, the CG 142 comprises a y-axis location at −4, −5, −6, −7, −8, −9, or −10 mm.

For fairway woods, the CG 142 comprises a y-axis 138 location ranging between −3 mm to −12 mm. In other embodiments, the CG 142 comprises a Y' axis location ranging between −3 mm to −7 mm, or −7 mm to −12 mm. For example, the CG 142 comprises a y-axis 138 location at −3, −4, −5, −6, −7, −8, −9, −10, −11, or −12 mm.

For hybrids, the CG 142 comprises a y-axis 138 location ranging between −3 mm to −12 mm. In other embodiments, the CG 142 comprises a y-axis 138 location ranging between −3 mm to −8 mm, or −8 mm to −12 mm. In other embodiments still, the CG 142 comprises a y-axis 138 location ranging between −4 mm to −8 mm, −5 mm to −9 mm, −6 mm to −10 mm, −7 mm to −11 mm, or −8 mm to −12 mm. For example, the CG 142 comprises a y-axis 138 location at −3, −4, −5, −6, −7, −8, −9, −10, −11, or −12 mm.

For drivers, the CG 142 can comprise a z-axis 140 location greater than 38 mm, greater than 40 mm, greater than 42 mm, greater than 45 mm, or greater than 48 mm. In other embodiments, the CG 142 can comprise a z-axis 140 location ranging between 38 mm to 55 mm. In other embodiments, the CG 142 can comprise a z-axis 140 location ranging between 38 mm to 45 mm, or 45 to 55 mm. For example, the CG 142 can comprise a z-axis location at 38, 39, 40, 41, 42, 43, 44, 45, 46, 47, 48, 49, 50, or 55 mm.

For fairway woods, the CG 142 can comprise a z-axis 140 location greater than 25 mm, greater than 28 mm, or greater than 30 mm. In other embodiments, the CG 142 can comprise a z-axis 140 location ranging between 25 mm to 40 mm. In other embodiments, the CG 142 can comprise a z-axis 140 location between 25 mm to 32 mm, or 32 mm to 40 mm. For example, the CG 142 comprises a z-axis 140 location of 25, 30, 31, 32, 33, 34, 35, 36, 37, 38, 39, or 40 mm.

For hybrids, CG 142 can comprise a z-axis 140 location greater than 15 mm, greater than 18 mm, greater than 20 mm, greater than 22 mm, or greater than 24 mm. In other embodiments, the CG 142 can comprise a z-axis 140 location ranging between 15 mm to 30 mm. In other embodiments, the CG 142 can comprise a z-axis 140 location between 15 mm to 25 mm, or 25 mm to 30 mm. In other embodiments still, the CG 142 can comprise a z-axis 140 location between 16 mm to 26 mm, 17 mm to 27 mm, 18 mm to 28 mm, 19 mm to 29 mm, or 20 mm to 30 mm. For example, the CG 142 comprises a z-axis 140 location of 15, 16, 17, 18, 19, 20, 21, 22, 23, 24 25, or 30 mm.

As described above and with reference to FIGS. 2-5, the center of gravity (CG) 142 defines the origin for a coordinate system having the CG x-axis 144, the CG y-axis 146, and the CG z-axis 148. The CG x-axis 144 is parallel to the x-axis 136, the CG y-axis 146 is parallel to the y-axis 138, and the CG z-axis is parallel to the z-axis 140. Further, the club head 100 comprises the moment of inertia Ixx about the CG x-axis 144 (i.e. crown-to-sole moment of inertia), and the moment of inertia Iyy about the CG y-axis 146 (i.e. heel-to-toe moment of inertia). In many embodiments, the crown-to-sole moment of inertia Ixx and the heel-to-toe moment of inertia Iyy are increased or maximized based on the amount of discretionary mass available to the club head designer. The moment of inertia represents the ability for the golf club head to resist twisting. A greater moment of inertia about the x-axis 144 improves the forgiveness for high and low off-center hits. A greater moment of inertia about the y-axis 146 improves the forgiveness for heel and toe off-center hits.

For drivers, in many embodiments, the crown-to-sole moment of inertia Ixx can be greater than approximately 3000 g-cm$^2$, greater than approximately 3250 g-cm$^2$, greater than approximately 3500 g-cm$^2$, greater than approximately 3750 g-cm$^2$, greater than approximately 4000 g-cm$^2$, greater than approximately 4250 g-cm$^2$, greater than approximately 4500 g-cm$^2$, greater than approximately 4750 g-cm$^2$, or greater than approximately 5000 g-cm$^2$.

For drivers, in other embodiments, the crown-to-sole moment of inertia Ixx can range between 3000 to 5000 g-cm$^2$. In other embodiments, the crown-to-sole moment of inertia Ixx can range between 3000 to 4000 g-cm$^2$, or 4000 to 5000 g-cm$^2$. For example, the crown-to-sole moment of inertia Ixx can be 3000, 3100, 3200, 3300, 3400, 3500, 3600, 3700, 3800, 3900, 4000, 4100, 4200, 4300, 4400, 4500, 4600, 4700, 4800, 4900, or 5000 g-cm$^2$.

For fairway woods, in many embodiments, the crown-to-sole moment of inertia Ixx can be greater than approximately 1200 g-cm$^2$, greater than approximately 1300 g-cm$^2$, greater than approximately 1400 g-cm$^2$, greater than approximately 1500 g-cm$^2$, greater than approximately 1600 g-cm$^2$, greater than approximately 1700 g-cm$^2$, greater than approximately 1800 g-cm$^2$, or greater than approximately 1900 g-cm$^2$.

For fairway woods, in other embodiments, the crown-to-sole moment of inertia Ixx can range between 1200 to 2200 g-cm$^2$. In other embodiments, the crown-to-sole moment of inertia Ixx can range between 1200 to 1700 g-cm$^2$, or 1700 to 2200 g-cm$^2$. For example, the crown-to-sole moment of inertia Ixx can be 1200, 1300, 1400, 1500, 1600, 1700, 1800, 1900, 20040, 2100, or 2200 g-cm$^2$.

For hybrids, in many embodiments, the crown-to-sole moment of inertia Ixx can be greater than approximately 880 g-cm$^2$, greater than approximately 890 g-cm$^2$, greater than approximately 900 g-cm$^2$, greater than approximately 910 g-cm$^2$, greater than approximately 920 g-cm$^2$, greater than approximately 930 g-cm$^2$, greater than approximately 940 g-cm$^2$, greater than approximately 950 g-cm$^2$, or greater than approximately 960 g-cm$^2$.

For hybrids, in other embodiments, the crown-to-sole moment of inertia Ixx can range from 880 to 1500 g-cm$^2$. In other embodiments, the crown-to-sole moment of inertia Ixx can range from 880 to 1200 g-cm$^2$, or 1200 to 1500 g-cm$^2$. In other embodiments still, the crown-to-sole moment of inertia Ixx can range from 900 to 1300 g-cm$^2$, 1000 to 1400 g-cm$^2$, or 1100 to 1500 g-cm$^2$. For example, the crown-to-sole moment of inertia Ixx can be 880, 900, 920, 930, 940, 950, 960, 970, 980, 990, 1000, 1020, 1100, 1200, 1300, 1400, or 1500 g-cm$^2$.

For drivers, in many embodiments, the heel-to-toe moment of inertia Iyy can be greater than approximately 4500 g-cm$^2$, greater than approximately 4800 g-cm$^2$, greater than approximately 5000 g-cm$^2$, greater than approximately 5100 g-cm$^2$, greater than approximately 5250 g-cm$^2$, greater than approximately 5500 g-cm$^2$, greater than approximately 5750 g-cm$^2$, or greater than approximately 6000 g-cm$^2$.

For drivers, in other embodiments, the heel-to-toe moment of inertia Iyy can range between 4500 and 6000 g-cm$^2$. In other embodiments, the heel-to-toe moment of inertia Iyy can range between 4500 to 5200 g-cm$^2$, or 5200 to 6000 g-cm$^2$. For example, the heel-to-toe moment of inertia Iyy can be 4500, 4600, 4700, 4800, 4900, 5000, 5100, 5200, 5300, 5400, 5500, 5600, 5700, 5800, 5900, or 6000 g-cm$^2$.

For fairway woods, the heel-to-toe moment of inertia Iyy can be greater than approximately 2700 g-cm$^2$, greater than approximately 2800 g-cm$^2$, greater than approximately 2900 g-cm$^2$, greater than approximately 3000 g-cm$^2$, greater than approximately 3100 g-cm$^2$, greater than approximately 3200 g-cm$^2$, or greater than approximately 3300 g-cm$^2$.

For fairway woods, the heel-to-toe moment of inertia Iyy can range between 2700 and 3500 g-cm$^2$. In other embodiments, the heel-to-toe moment of inertia Iyy can range between 2700 to 3100 g-cm$^2$, or 3100 to 3500 g-cm$^2$. In other embodiments still, the heel-to-toe moment of inertia Iyy can range between 2700 to 3200 g-cm$^2$, or 3200 to 3500 g-cm$^2$. For example, the heel-to-toe moment of inertia Iyy can be 2700, 2800, 2900, 3000, 3100, 3200, 3300, 3400, or 3500 g-cm$^2$.

For hybrids, in many embodiments, the heel-to-toe moment of inertia Iyy can be greater than approximately 2400 g-cm$^2$, greater than approximately 2500 g-cm$^2$, greater than approximately 2600 g-cm$^2$, greater than approximately 2700 g-cm$^2$, greater than approximately 2800 g-cm$^2$, greater than approximately 2900 g-cm$^2$, or greater than approximately 3000 g-cm$^2$.

For hybrids, in other embodiments, the heel-to-toe moment of inertia Iyy can range from 2400 to 3200 g-cm$^2$. In other embodiments, the heel-to-toe moment of inertia Iyy can range from 2400 to 2700 g-cm$^2$, or 2700 to 3200 g-cm$^2$. In other embodiments still, the heel-to-toe moment of inertia Iyy can range from 2400 to 2900, 2500 to 3000, 2600 to 3100, or 2700 to 3200 g-cm$^2$. For example, the heel-to-toe moment of inertia Iyy can be 2400, 2500, 2600, 2700, 2750, 2800, 2850, 2900, 2950, 3000, 3100, or 3200 g-cm$^2$.

For drivers, the combined moment of inertia (i.e. the sum of the crown-to-sole moment of inertia Ixx and the heel-to-sole moment of inertia Iyy) can be greater than 8000 g-cm$^2$, greater than 8500 g-cm$^2$, greater than 9000 g-cm$^2$, greater than 9500 g-cm$^2$, greater than 10000 g-cm$^2$, greater than 11000 g-cm$^2$, or greater than 12000 g-cm$^2$.

For fairway woods, the combined moment of inertia (i.e. the sum of the crown-to-sole moment of inertia Ixx and the heel-to-sole moment of inertia Iyy) can be greater than 4000 g-cm$^2$, greater than 4100 g-cm$^2$, greater than 4200 g-cm$^2$, greater than 4300 g-cm$^2$, greater than 4400 g-cm$^2$, greater than 4500 g-cm$^2$, greater than 4600 g-cm$^2$, greater than 4700 g-cm$^2$, or greater than 4800 g-cm$^2$.

For hybrids, the combined moment of inertia (i.e. the sum of the crown-to-sole moment of inertia Ixx and the heel-to-sole moment of inertia Iyy) can be greater than 3500 g-cm$^2$, greater than 3600 g-cm$^2$, greater than 3700 g-cm$^2$, greater than 3800 g-cm$^2$, greater than 3900 g-cm$^2$, greater than 4000 g-cm$^2$, greater than 4100 g-cm$^2$, or greater than 4200 g-cm$^2$.

Method of Manufacturing Golf Club Heads and Club Faces

A method of manufacturing is provided to produce a club head 100 having a club face with a variable thickness profile. The method includes providing a club face and body, wherein the club face and the body are secured together to define a substantially hollow structure. The body further having a heel 136, a toe 138 opposite the heel 136, a crown 132, and a sole 134. The method further includes providing the club face with a striking surface 144, a back surface 146 opposite the striking surface 144, and a varying thickness profile. The club head 100 having the body and the club face with the variable thickness profile can be created or formed by casting, forging, machining, or any suitable method or combination thereof. In some embodiments, the club head 100 can be created or formed by casting the body and the club face. In some embodiments, the club head 100 can be created or formed by casting the body and machining the club face. In some embodiments, the club head 100 can be created or formed by machining both the club face and the body. In many embodiments, the club face can be welded onto the body by various welding methods such as laser welding, plasma welding, or other welding methods. In some embodiments, the club head 100 can be created or formed by casting the body, forging the club face, and welding the club face onto the body.

The method of manufacturing the club head 100 described herein is merely exemplary and is not limited to the embodiments presented herein. The method can be employed in many different embodiments or examples not specifically depicted or described herein. In some embodiments, the processes of the method described can be performed in any suitable order. In other embodiments, one or more of the processes may be combined, separated, or skipped.

EXAMPLES

Example 1—Exemplary Variable Thickness Profile and Characteristic Time for Wood-Type Club Head An exemplary wood-type club head comprises the first variable thickness profile embodiment having the club face 202 as described in this disclosure. The club face 202 comprises a variable thickness profile that is shifted and angled from the face center. The club face 202 comprises the center region 222 having the center thickness 226, the transition region 242 having the tapering thickness, and perimeter region 254 having the perimeter thickness 258. The center thickness 226 is 0.079 inch. The perimeter thickness 258 is different or equal in the high toe, low toe, and heel areas of the club face 202. The perimeter thickness 258 in the high toe area is a constant 0.064 inch, the low toe area is a constant 0.064 inch, and the heel area is a constant 0.063 inch. Further, the center region 222 (i.e. center region center 230) is shifted 0.2 inch toward the toe, and the variable thickness profile is angled at 5 degrees with respect to the x-axis 136 toward the high toe.

TABLE 1

| Characteristic Time Measured Along X-axis | |
|---|---|
| Reference point locations from Face Center (inches) (−toe, +heel) | Characteristic Time (μs) |
| −0.84 | 222 |
| −0.42 | 230 |
| 0 | 226 |
| 0.42 | 221 |
| 0.84 | 197 |

Referring to Table 1, the characteristic time is measured at the face center, and at one or more reference points. The one or more reference points are measured at specific intervals or increments along the x-axis 136. The one or more reference points are measured along the horizontal x-axis 136 at intervals of 0.42 inch, or approximately 10 mm.

The characteristic time measured at a first reference point along the horizontal x-axis 136 at a 0.84 inch offset from the face center in a direction toward the toe is 222 μs. The characteristic time measured at a second reference point along the horizontal x-axis 136 at a 0.42 inch offset from the face center in a direction toward the toe is 230 μs. The characteristic time measured at the face center is 226 μs. The characteristic time measured at a third reference point along the horizontal x-axis 136 at a 0.42 inch offset from the face center in a direction toward the heel is 221 μs. The characteristic time measured at a fourth reference point along the horizontal x-axis 136 at a 0.84 inch offset from the face center in a direction toward the heel is 197 μs.

Referring to Table 1, the characteristic time measured at the first reference point deviates less than 10 μs from the characteristic time measured at the face center. The characteristic time measured at the second reference point deviates less than 10 μs or 5 μs from the characteristic time measured at the face center. The characteristic time measured at the third reference point deviates less 10 μs or 5 μs from the characteristic time measured at the face center. The characteristic time measured at the second reference point deviates less than 10 μs or 5 μs from the characteristic time measured at the third reference point. Further, the characteristic time measured at the first reference point deviates less than 10 μs from the characteristic time measured at the third reference point. Further still, the characteristic time measured at 0.42 inch or approximately 10 mm intervals between the first reference point and the face center deviate less than 10 μs or 5 μs from the characteristic time at the face center. Characteristic time measurements between reference points that are less than 10 μs or 5 μs provides consistent ball performance for center and off-center hits.

With continued reference to Table 1, the highest characteristic time along the horizontal x-axis 136 is 230 μs measured at the second reference point, and the lowest characteristic time along the horizontal x-axis 136 is 197 μs measured at the fourth reference point. The club face 202 comprising the variable thickness profile provides a gap of 33 μs between the highest and lowest CT. The club face 202 comprising the variable thickness profile reduces the gap between CT values along the horizontal x-axis 136 thereby providing consistent ball performance for center and off-center hits.

Example 2—Exemplary Variable Thickness Profile and Characteristic Time for Wood-Type Club Head An exemplary wood-type club head comprises the first variable thickness profile embodiment having the club face 202 as described in this disclosure. The club face 202 comprises a variable thickness profile that is shifted and angled from the face center. The club face 202 comprises the center region 222 having the center thickness 226, the transition region 242 having the tapering thickness, and perimeter region 254 having the perimeter thickness 258. The center thickness 226 is 0.081 inch. The perimeter thickness 258 is different in the high toe, low toe, and heel areas of the club face 202. The perimeter thickness 258 in the high toe area is a constant 0.064 inch, the low toe area is a constant 0.067 inch, and the heel area is a constant 0.060 inch. Further, the center region 222 (i.e. center region center 230) is shifted 0.2 inch toward the toe, and the variable thickness profile is angled at 5 degrees with respect to the x-axis 136 toward the high toe.

TABLE 2

| Characteristic Time Measured Along X-axis | |
|---|---|
| Reference point locations from Face Center (inches) (−toe, +heel) | Characteristic Time (μs) |
| −0.84 | 215 |
| −0.42 | 222 |
| 0 | 223 |
| 0.42 | 220 |
| 0.84 | 205 |

Referring to Table 2, the characteristic time is measured at the face center, and at one or more reference points. The one or more reference points are measured at specific intervals or increments along the x-axis 136. The one or more reference points are measured along the horizontal x-axis 136 at intervals of 0.42 inch, or approximately 10 mm.

The characteristic time measured at a first reference point along the horizontal x-axis 136 at a 0.84 inch offset from the face center in a direction toward the toe is 215 μs. The characteristic time measured at a second reference point along the horizontal x-axis 136 at a 0.42 inch offset from the face center in a direction toward the toe is 222 μs. The characteristic time measured at the face center is 223 μs. The characteristic time measured at a third reference point along the horizontal x-axis 136 at a 0.42 inch offset from the face center in a direction toward the heel is 220 μs. The characteristic time measured at a fourth reference point along the horizontal x-axis 136 at a 0.84 inch offset from the face center in a direction toward the heel is 205 μs.

Referring to Table 2, the characteristic time measured at the first reference point deviates less than 10 μs from the characteristic time measured at the face center. The characteristic time measured at the second reference point deviates less than 10 μs or 5 μs from the characteristic time measured at the face center. The characteristic time measured at the third reference point deviates less 10 μs or 5 μs from the characteristic time measured at the face center. The characteristic time measured at the second reference point deviates less than 10 μs or 5 μs from the characteristic time measured at the third reference point. Further, the characteristic time measured at the first reference point deviates less than 10 μs from the characteristic time measured at the third reference point. Further still, the characteristic time measured at 0.42 inch or 10 mm intervals between the first reference point and the face center deviate less than 10 μs from the characteristic time at the face center. Characteristic time measurements between reference points that are less than 10 μs or 5 μs provides consistent ball performance for center and off-center hits.

With continued reference to Table 2, the highest characteristic time along the horizontal x-axis 136 is 223 μs measured at the face center, and the lowest characteristic time along the horizontal x-axis 136 is 205 μs measured at the fourth reference point. The club face 202 comprising the variable thickness profile provides a gap of 18 μs between the highest and lowest CT. The club face 202 comprising the variable thickness profile reduces the gap between CT values along the horizontal x-axis 136 thereby providing consistent ball performance for center and off-center hits.

Example 3—Exemplary Variable Thickness Profile and Characteristic Time for Wood-Type Club Head An exemplary wood-type club head comprises the first variable thickness profile embodiment having the club face 202 as described in this disclosure. The club face 202 comprises a variable thickness profile that is shifted and angled from the face center. The club face 202 comprises the center region 222 having the center thickness 226, the transition region 242 having the tapering thickness, and perimeter region 254 having the perimeter thickness 258. The center thickness 226 is 0.081 inch. The perimeter thickness 258 is different in the high toe, low toe, and heel areas of the club face 202. The perimeter thickness 258 in the high toe area is a constant 0.064 inch, the low toe area is a constant 0.065 inch, and the heel area is a constant 0.067 inch. Further, the center region 222 (i.e. center region center 230) is shifted 0.2 inch toward the toe, and the variable thickness profile of club face 202 is angled at 5 degrees with respect to the x-axis 136 toward the high toe.

TABLE 3

| Characteristic Time Measured Along X-Axis | |
|---|---|
| Reference point locations from Face Center (inches) (−toe, +heel) | Characteristic Time (μs) |
| −0.84 | 219 |
| −0.42 | 224 |
| 0 | 225 |
| 0.42 | 220 |
| 0.84 | 192 |

Referring to Table 3, the characteristic time is measured at the face center, and at one or more reference points. The one or more reference points are measured at specific intervals or increments along the x-axis 136. The one or more reference points are measured along the horizontal x-axis 136 at intervals of 0.42 inch, or approximately 10 mm.

The characteristic time measured at a first reference point along the horizontal x-axis 136 at a 0.84 inch offset from the face center in a direction toward the toe is 219 μs. The characteristic time measured at a second reference point along the horizontal x-axis 136 at a 0.42 inch offset from the face center in a direction toward the toe is 224 μs. The characteristic time measured at the face center is 225 μs. The characteristic time measured at a third reference point along the horizontal x-axis 136 at a 0.42 inch offset from the face center in a direction toward the heel is 220 μs. The characteristic time measured at a fourth reference point along the horizontal x-axis 136 at a 0.84 inch offset from the face center in a direction toward the heel is 192 μs.

Referring to Table 3, the characteristic time measured at the first reference point deviates less than 10 μs from the characteristic time measured at the face center. The characteristic time measured at the second reference point deviates less than 10 μs or 5 μs from the characteristic time measured at the face center. The characteristic time measured at the third reference point deviates less 10 μs from the characteristic time measured at the face center. The characteristic time measured at the second reference point deviates less than 10 μs or 5 μs from the characteristic time measured at the third reference point. Further, the characteristic time measured at the first reference point deviates less than 10 μs or 5 μs from the characteristic time measured at the third reference point. Further still, the characteristic time measured at 0.42 inch or approximately 10 mm intervals between the first reference point and the face center deviate less than 10 μs from the characteristic time at the face center. Characteristic time measurements between reference points that are less than 10 μs or 5 μs provides consistent ball performance for center and off-center hits.

With continued reference to Table 3, the highest characteristic time along the horizontal x-axis 136 is 225 μs measured at the face center, and the lowest characteristic time along the horizontal x-axis 136 is 192 μs measured at the fourth reference point. The club face 202 comprising the variable thickness profile provides a gap of 33 μs between the highest and lowest CT. The club face 202 comprising the variable thickness profile reduces the gap between CT values measured at the heel and toe along the horizontal x-axis 136 thereby providing consistent ball performance for center and off-center hits.

Example 4—Exemplary Variable Thickness Profile and Characteristic Time for Wood-Type Club Head An exemplary wood-type club head comprises the second variable thickness profile embodiment having the club face 302 as described in this disclosure. The club face 302 comprises a variable thickness profile having a toe side width greater than a heel side width. Further, the club face 302 comprises a variable thickness profile that is shifted and angled from the face center. The club face 302 comprises the center region 322 having the center thickness 326, the transition region 350 having the tapering thickness, and perimeter region 372 having the perimeter thickness 374. The center thickness 326 is 0.075 inch. The perimeter thickness 374 is constant and equal in the toe and heel areas of the club face 302. The perimeter thickness 374 is 0.06 inch. The center region 322 (i.e. center region center 344) is shifted 0.05 inch toward the toe and 0.05 inch toward the crown, and the center region 322 is angled at 2.5 degrees with respect to the x-axis 136. Further, the center region length 342 is approximately 1.19 inch, the toe side width 338 of the center region 322 is 0.225 inch, and the heel side width 340 of the center region 322 is 0.15 inch.

The transition region 350 (i.e. transition region center 368) is shifted 0.025 inch toward the toe and 0.05 inch toward the crown, and the transition region 350 is angled at 2.5 degrees with respect to the x-axis 136. Further, the transition region length 366 is 1.9 inch, the toe side width 362 of the transition region 350 is 0.75 inch, and the heel side width 364 of the transition region 350 is 0.5 inch.

TABLE 4

| Characteristic Time Measured Along X-Axis | |
|---|---|
| Reference point locations from Face Center (inches) (−toe, +heel) | Characteristic Time (μs) |
| −0.84 | 223 |
| −0.42 | 222 |
| 0 | 225.4 |

TABLE 4-continued

| Characteristic Time Measured Along X-Axis | |
|---|---|
| Reference point locations from Face Center (inches) (−toe, +heel) | Characteristic Time (μs) |
| 0.42 | 216.8 |
| 0.84 | 200.4 |

Referring to Table 4, the characteristic time is measured at the face center, and at one or more reference points. The one or more reference points are measured at specific intervals or increments along the x-axis 136. The one or more reference points are measured along the horizontal x-axis 136 at intervals of 0.42 inch, or approximately 10 mm.

The characteristic time measured at a first reference point along the horizontal x-axis 136 at a 0.84 inch offset from the face center in a direction toward the toe is 223 μs. The characteristic time measured at a second reference point along the horizontal x-axis 136 at a 0.42 inch offset from the face center in a direction toward the toe is 222 μs. The characteristic time measured at the face center is 225.4 μs. The characteristic time measured at a third reference point along the horizontal x-axis 136 at a 0.42 inch offset from the face center in a direction toward the heel is 216.8 μs. The characteristic time measured at a fourth reference point along the horizontal x-axis 136 at a 0.84 inch offset from the face center in a direction toward the heel is 200.4 μs.

Referring to Table 4, the characteristic time measured at the first reference point deviates less than 10 μs or 5 μs from the characteristic time measured at the face center. The characteristic time measured at the second reference point deviates less than 10 μs or 5 μs from the characteristic time measured at the face center. The characteristic time measured at the third reference point deviates less 10 μs from the characteristic time measured at the face center. The characteristic time measured at the second reference point deviates less than 10 μs from the characteristic time measured at the third reference point. Further, the characteristic time measured at the first reference point deviates less than 10 μs from the characteristic time measured at the third reference point. Further still, the characteristic time measured at 0.42 inch or approximately 10 mm intervals between the first reference point and the face center deviate less than 10 μs or 5 μs from the characteristic time at the face center. Characteristic time measurements between reference points that are less than 10 μs or 5 μs provides consistent ball performance for center and off-center hits.

With continued reference to Table 4, the highest characteristic time along the horizontal x-axis 136 is 225.4 μs measured at the face center, and the lowest characteristic time along the horizontal x-axis 136 is 200.4 μs measured at the fourth reference point. The club face 302 comprising the variable thickness profile provides a gap of 25 μs between the highest and lowest CT measured along the horizontal x-axis 136. The club face 302 comprising the variable thickness profile reduces the gap between CT values measured at the heel and toe along the horizontal x-axis 136 thereby providing consistent ball performance for center and off-center hits.

Example 5—Club Face Weight Percentage

An exemplary wood-type club head comprising a variable thickness profile was compared to a similar control wood-type club head comprising a variable thickness profile. The control wood-type club head was devoid of a thickness profile that was shifted toward the toe and angled towards the high toe. The control club head comprises a center region with a center thickness of 0.078 inch and a perimeter region with a perimeter thickness of 0.063 inch. The center region of the control club head was centered around the face center and was not shifted or angled from the face center.

The exemplary wood-type club head comprises the first variable thickness profile embodiment having the club face 202 as described in this disclosure. The club face 202 comprises the variable thickness profile that is shifted and angled from the face center. The club face 202 comprises the center region 222 having the center thickness 226, the transition region 242 having the tapering thickness, and perimeter region 254 having the perimeter thickness 258. The center thickness 226 is 0.078 inch. The perimeter thickness 258 is 0.063 inch. Further, the center region 222 (i.e. center region center 230) is shifted 0.2 inch toward the toe, and the variable thickness profile is angled at 5 degrees with respect to the x-axis 136 toward the high toe.

TABLE 5

| Percent of Club Face Weight | | |
|---|---|---|
| Quadrants | Control Club Head Percent of Club Face Weight | Exemplary Club Head Percent of Club Face Weight |
| High Toe | 36.1% | 37.0% |
| High Heel | 21.5% | 21.0% |
| Low Heel | 19.5% | 19.1% |
| Low Toe | 23.0% | 22.9% |

The control club face weight was compared to the exemplary club face weight. The club face weight was compared with reference to the quadrant system described above having the high toe quadrant 160, the low toe quadrant 162, the high heel quadrant 164, and the low heel quadrant 166. A larger club face weight percentage corresponds to a greater stiffness and a lower club face weight percentage corresponds to a lower stiffness.

Referring to Table 5, the control club head comprises percentages of club face weight in reference to the quadrant system. The high toe quadrant 160 comprises 36.1% of the total club face weight. The high heel quadrant 164 comprises 21.5% of the total club face weight. The low heel quadrant 166 comprises 19.5% of the total club face weight. The low toe quadrant 162 comprises 23.0% of the total club face weight.

Referring to Table 5, the exemplary club head comprises percentages of club face weight in reference to the quadrant system. The high toe quadrant 160 comprises 37.0% of the total club face weight. The high heel quadrant 164 comprises 21.0% of the total club face weight. The low heel quadrant 166 comprises 19.1% of the total club face weight. The low toe quadrant 162 comprises 22.9% of the total club face weight.

The comparison resulted in the exemplary club head comprising a greater club face weight percentage than the control club head in the high toe quadrant 160. The comparison results in the exemplary club head comprising a lower club face weight percentage than the control club head in the low heel quadrant 166. The exemplary club head comprising the club face 202 resulted in greater stiffness in the high toe area of the club face, and lower stiffness in the low heel area of the club face. The exemplary club head comprising the club face 202 comprised a characteristic time between 20 to 26 μs, or 26 to 32 μs less than the control club head when measured at the highest characteristic time location (i.e. high toe area). Further, the exemplary club head comprising the club face 202 comprised a characteristic time between 2 to 7 μs, or 7 to 12 μs greater than the control club head when measured at the heel area of the club face. The exemplary club head comprised the variable thickness profile that was shifted toward the toe and angled toward the high toe away from the face center. Shifting and angling the variable thickness profile toward the high toe area of the club face increases high toe stiffness and decreases heel stiffness. The increased high toe stiffness of the exemplary club head decreased the characteristic time within the high toe area of the club face and increased the characteristic time within the heel area of the club face. The exemplary club head provided consistent characteristic time measured across the club face when compared to the control club head.

Replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims.

As the rules to golf may change from time to time (e.g., new regulations may be adopted or old rules may be eliminated or modified by golf standard organizations and/or governing bodies such as the United States Golf Association (USGA), the Royal and Ancient Golf Club of St. Andrews (R&A), etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

Clause 1. A golf club head comprising: a heel; a toe; a crown; a sole; and a face comprising a striking surface and configured to impact a golf ball; wherein the face comprises a face center defining an origin for a coordinate system including a horizontal x-axis extending parallel to the ground and in a direction extending from the heel to the toe when the club head is at an address position; wherein the face defines a variable thickness including a thickened center region encompassing the face center, a thinned perimeter region, and a transition region tapering the face thickness from the thickened center region to the thinned perimeter region to adjust a characteristic time of the face; wherein the thickened center region comprises a center region center offset toward the toe from the face center; wherein center region center is offset from the face center by a horizontal offset distance measured parallel to the horizontal x-axis, the horizontal offset distance ranges from greater than 0 to 0.5 inch; wherein the center thickened region is offset from the face center by an offset angle, the offset angle being defined between the horizontal x-axis and a line extending through the face center and the center region center, the offset angle ranges between greater than 0 and 10 degrees; wherein the face further comprises a first reference point along the horizontal x-axis at approximately a 10 mm offset from the face center in a direction toward the heel; and a second reference point along the horizontal x-axis at approximately a 10 mm offset from the face center in a direction toward the toe; and wherein the characteristic time measured at approximately 10 mm intervals between the first reference point and the second reference point along the horizontal x-axis deviates less than 10 μs from the characteristic time at the face center.

Clause 2. The golf club head of clause 1, wherein the face comprises a rear surface opposite the striking surface; wherein when viewing the rear surface of the club face, the center region comprises a shape from the group consisting of elliptical, oval, circular, egg, asymmetric elliptical, and oblong-ellipse.

Clause 3. The golf club head of clause 1, wherein the thickened center region comprises a center thickness ranging between 0.06 to 0.1 inch.

Clause 4. The golf club head of clause 1, wherein the thinned perimeter region comprises a perimeter thickness ranging between 0.05 to 0.09 inch.

Clause 5. The golf club head of clause 1, wherein the characteristic time at the first reference point deviates less than 10 μs from the characteristic time measured at the second reference point.

Clause 6. The golf club head of clause 1, wherein the club head comprises a weight port configured to receive and retain a removable weight.

Clause 7. The golf club head of clause 1, wherein the golf club head comprises a center of gravity defining an origin for a coordinate system including a horizontal CG x-axis parallel to the ground and in a direction from the heel to the toe, and a vertical CG y-axis perpendicular to the ground and in a direction extending from the sole to the crown when the club head is at the address position; the club head comprises a moment of inertia Ixx measured about the CG x-axis and a moment of inertia Iyy measured about the CG y-axis.

Clause 8. The golf club head of clause 7, the moment of inertia Ixx is greater than 1400 g-cm$^2$, and the moment of inertia Iyy is greater than 2800 g-cm$^2$.

Clause 9. A golf club head comprising: a heel; a toe; a crown; a sole; and a face comprising a striking surface and configured to impact a golf ball; wherein the face comprises a face center defining an origin for a coordinate system including a horizontal x-axis extending parallel to the ground and in a direction extending from the heel to the toe when the club head is at an address position; wherein the face defines a variable thickness including a thickened center region encompassing the face center, a thinned perimeter region, and a transition region tapering the face thickness from the thickened center region to the thinned perimeter region to adjust a characteristic time of the face; wherein thickened center region comprises a perimeter edge including a toe edge, a heel edge opposite the toe edge, a top edge, and a bottom edge opposite the top edge; wherein thickened center region comprises a toe side width measured at the toe edge, the toe side width ranges between 0.1 to 0.5 inch; wherein the thickened center region comprises a heel side width measured at the heel edge, the heel side width ranges between 0.05 to 0.35 inch; wherein the toe side width of the center region is greater than the heel side width of the center region; wherein the thickened center region comprises a center region center offset toward the toe from the face center; wherein center region center is offset from the face center by a horizontal offset distance measured parallel to the horizontal x-axis, the horizontal offset distance ranges from greater than 0 to 0.5 inch; wherein the center thickened region is offset from the face center by an offset angle, the offset angle being defined between the horizontal x-axis and a line extending through the face center and the center region center, the offset angle ranges between greater than 0 and 10 degrees; wherein the face further comprises a first reference point along the horizontal x-axis at approximately a 10 mm offset from the face center in a direction toward the heel; and a second reference point along the horizontal x-axis at approximately a 10 mm offset from the face center in a direction toward the toe; and wherein the characteristic time measured at approximately 10 mm intervals between the first reference point and the second reference point along the horizontal x-axis deviates less than 10 μs from the characteristic time at the face center.

Clause 10. The golf club head of clause 9, wherein transition region comprises a perimeter edge including a toe edge, a heel edge opposite the toe edge, a top edge, and a bottom edge opposite the top edge; wherein the transition region comprises a heel side width measured at the heel edge; wherein the transition region comprises a toe side width measured at the toe edge; and wherein the toe width of the transition region is greater than the heel width of the transition region.

Clause 11. The golf club head of clause 9, wherein the thickened center region comprises a center thickness ranging between 0.06 to 0.1 inch; and wherein the thinned perimeter region comprises a perimeter thickness ranging between 0.05 to 0.09 inch.

Clause 12. The golf club head of clause 9, wherein the club head comprises a weight port configured to receive and retain a removable weight.

Clause 13. The golf club head of clause 9, wherein the golf club head comprises a center of gravity defining an origin for a coordinate system including a horizontal CG x-axis parallel to the ground and in a direction from the heel to the toe, and a vertical CG y-axis perpendicular to the ground and in a direction extending from the sole to the crown when the club head is at the address position; the club head comprises a moment of inertia Ixx measured about the CG x-axis and a moment of inertia Iyy measured about the CG y-axis.

Clause 14. The golf club head of clause 13, the moment of inertia Ixx is greater than 1400 g-cm$^2$, and the moment of inertia Iyy is greater than 2800 g-cm$^2$.

Clause 15. A golf club head comprising: a heel; a toe; a crown; a sole; and a face comprising a striking surface and configured to impact a golf ball; wherein the face comprises a face center defining an origin for a coordinate system including a horizontal x-axis extending parallel to the ground and in a direction extending from the heel to the toe when the club head is at an address position; wherein the face defines a variable thickness including a thickened center region encompassing the face center, a thinned perimeter region, and a transition region tapering the face thickness from the thickened center region to the thinned perimeter region to adjust a characteristic time of the face; wherein the thickened center region comprises a center region center offset toward the toe from the face center; wherein center region center is offset from the face center by a horizontal offset distance measured parallel to the horizontal x-axis, the horizontal offset distance ranges from greater than 0 to 0.5 inch; wherein the center thickened region is offset from the face center by an offset angle, the offset angle being defined between the horizontal x-axis and a line extending through the face center and the center region center, the offset angle ranges between greater than 0 and 10 degrees; wherein the thickened center region comprises a center thickness ranging between 0.06 to 0.1 inch; wherein the thinned perimeter region comprises a perimeter thickness ranging between 0.05 to 0.09 inch; wherein the face further comprises a first reference point along the horizontal x-axis at approximately a 10 mm offset from the face center in a direction toward the heel; and a second reference point along the horizontal x-axis at approximately a 10 mm offset from the face center in a direction toward the toe; and wherein the characteristic time measured at approximately 10 mm intervals between the first reference point and the second reference point along the horizontal x-axis deviates less than 10 μs from the characteristic time at the face center.

Clause 16. The golf club head of clause 15, wherein the face comprises a rear surface opposite the striking surface; wherein when viewing the rear surface of the club face, the center region comprises a shape from the group consisting of elliptical, oval, circular, egg, asymmetric elliptical, and oblong-ellipse.

Clause 17. The golf club head of clause 15, wherein the characteristic time at the first reference point deviates less than 10 μs from the characteristic time measured at the second reference point.

Clause 18. The golf club head of clause 15, wherein the club head comprises a weight port configured to receive and retain a removable weight.

Clause 19. The golf club head of clause 15, wherein the golf club head comprises a center of gravity defining an origin for a coordinate system including a horizontal CG x-axis parallel to the ground and in a direction from the heel to the toe, and a vertical CG y-axis perpendicular to the ground and in a direction extending from the sole to the crown when the club head is at the address position; the club head comprises a moment of inertia Ixx measured about the CG x-axis and a moment of inertia Iyy measured about the CG y-axis.

Clause 20. The golf club head of clause 19, the moment of inertia Ixx is greater than 1400 g-cm2, and the moment of inertia Iyy is greater than 2800 g-cm2.

Various features and advantages of the disclosure are set forth in the following claims.

What is claimed is:

1. A golf club head comprising:

a heel; a toe; a crown; a sole; and a face comprising a striking surface, which further comprises a face perimeter surrounding the striking surface, and configured to impact a golf ball;

wherein the face comprises a face center defining an origin for a coordinate system including a horizontal x-axis extending parallel to the ground and in a direction extending from the heel to the toe when the club head is at an address position;

wherein the face defines a variable thickness including a thickened center region encompassing the face center, a perimeter region, and a transition region tapering the face thickness from the thickened center region to the perimeter region to adjust a characteristic time of the face;

wherein the thickened center region comprises a center region center offset toward the toe from the face center;

wherein center region center is offset from the face center by a horizontal offset distance measured parallel to the horizontal x-axis, the horizontal offset distance ranges from greater than 0 to 0.5 inch;

wherein the center thickened region is offset from the face center by an offset angle, the offset angle being defined between the horizontal x-axis and a line extending through the face center and the center region center, the offset angle ranges between greater than 0 and 10 degrees;

wherein the perimeter region surrounds the transition region and abuts the face perimeter, and further comprises a thickened perimeter portion located at the toe and a thinned perimeter portion located at the heel;

wherein a thickened perimeter portion thickness is in a range of 0.07 inch to 0.10 inch and a thinned perimeter portion thickness is in a range of 0.05 inch to 0.07 inch;

wherein the face further comprises a first reference point along the horizontal x-axis at approximately a 10 mm offset from the face center in a direction toward the heel; and a second reference point along the horizontal x-axis at approximately a 10 mm offset from the face center in a direction toward the toe; and wherein the characteristic time measured at approximately 10 mm intervals between the first reference point and the second reference point along the horizontal x-axis deviates less than 10 μs from the characteristic time at the face center.

2. The golf club head of claim 1, wherein the face comprises a rear surface opposite the striking surface; wherein when viewing the rear surface of the club face, the center region comprises a shape from the group consisting of elliptical, oval, circular, egg, asymmetric elliptical, and oblong-ellipse.

3. The golf club head of claim 1, wherein the thickened center region comprises a center thickness ranging between 0.06 to 0.1 inch.

4. The golf club head of claim 1, wherein the characteristic time at the first reference point deviates less than 10 μs from the characteristic time measured at the second reference point.

5. The golf club head of claim 1, wherein the club head comprises a weight port configured to receive and retain a removable weight.

6. The golf club head of claim 1, wherein the golf club head comprises a center of gravity defining an origin for a coordinate system including a horizontal CG x-axis parallel to the ground and in a direction from the heel to the toe, and a vertical CG y-axis perpendicular to the ground and in a direction extending from the sole to the crown when the club head is at the address position; the club head comprises a moment of inertia Ixx measured about the CG x-axis and a moment of inertia Iyy measured about the CG y-axis.

7. The golf club head of claim 6, the moment of inertia Ixx is greater than 1400 g-$cm^2$, and the moment of inertia Iyy is greater than 2800 g-$cm^2$.

8. A golf club head comprising:

a heel; a toe; a crown; a sole; and a face comprising a striking surface, which further comprises a face perimeter surrounding the striking surface, and configured to impact a golf ball;

wherein the face comprises a face center defining an origin for a coordinate system including a horizontal x-axis extending parallel to the ground and in a direction extending from the heel to the toe when the club head is at an address position;

wherein the face defines a variable thickness including a thickened center region encompassing the face center, a perimeter region, and a transition region tapering the face thickness from the thickened center region to the perimeter region to adjust a characteristic time of the face;

wherein thickened center region comprises a perimeter edge including a toe edge, a heel edge opposite the toe edge, a top edge, and a bottom edge opposite the top edge;

wherein thickened center region comprises a toe side width measured at the toe edge, the toe side width ranges between 0.1 to 0.5 inch;

wherein the thickened center region comprises a heel side width measured at the heel edge, the heel side width ranges between 0.05 to 0.35 inch;

wherein the toe side width of the center region is greater than the heel side width of the center region;

wherein the thickened center region comprises a center region center offset toward the toe from the face center; wherein center region center is offset from the face center by a horizontal offset distance measured parallel to the horizontal x-axis, the horizontal offset distance ranges from greater than 0 to 0.5 inch;

wherein the center thickened region is offset from the face center by an offset angle, the offset angle being defined between the horizontal x-axis and a line extending through the face center and the center region center, the offset angle ranges between greater than 0 and 10 degrees;

wherein the perimeter region surrounds the transition region and abuts the face perimeter, and further comprises a thickened perimeter portion located at the toe and a thinned perimeter portion located at the heel;

wherein a thickened perimeter portion thickness is in a range of 0.07 inch to 0.10 inch and a thinned perimeter portion thickness is in a range of 0.05 inch to 0.07 inch;

wherein the face further comprises a first reference point along the horizontal x-axis at approximately a 10 mm offset from the face center in a direction toward the heel; and a second reference point along the horizontal x-axis at approximately a 10 mm offset from the face center in a direction toward the toe; and wherein the characteristic time measured at approximately 10 mm intervals between the first reference point and the second reference point along the horizontal x-axis deviates less than 10 μs from the characteristic time at the face center.

9. The golf club head of claim 8, wherein transition region comprises a perimeter edge including a toe edge, a heel edge opposite the toe edge, a top edge, and a bottom edge opposite the top edge; wherein the transition region comprises a heel side width measured at the heel edge; wherein the transition region comprises a toe side width measured at the toe edge; and wherein the toe width of the transition region is greater than the heel width of the transition region.

10. The golf club head of claim 8, wherein the thickened center region comprises a center thickness ranging between 0.06 to 0.1 inch.

11. The golf club head of claim 8, wherein the club head comprises a weight port configured to receive and retain a removable weight.

12. The golf club head of claim 8, wherein the golf club head comprises a center of gravity defining an origin for a coordinate system including a horizontal CG x-axis parallel to the ground and in a direction from the heel to the toe, and a vertical CG y-axis perpendicular to the ground and in a direction extending from the sole to the crown when the club head is at the address position; the club head comprises a moment of inertia Ixx measured about the CG x-axis and a moment of inertia Iyy measured about the CG y-axis.

13. The golf club head of claim 12, the moment of inertia Ixx is greater than 1400 g-cm$^2$, and the moment of inertia Iyy is greater than 2800 g-cm$^2$.

14. A golf club head comprising:

a heel; a toe; a crown; a sole; and a face comprising a striking surface, which further comprises a face perimeter surrounding the striking surface, and configured to impact a golf ball;

wherein the face comprises a face center defining an origin for a coordinate system including a horizontal x-axis extending parallel to the ground and in a direction extending from the heel to the toe when the club head is at an address position;

wherein the face defines a variable thickness including a thickened center region encompassing the face center, a perimeter region, and a transition region tapering the face thickness from the thickened center region to the perimeter region to adjust a characteristic time of the face;

wherein the thickened center region comprises a center region center offset toward the toe from the face center; wherein center region center is offset from the face center by a horizontal offset distance measured parallel to the horizontal x-axis, the horizontal offset distance ranges from greater than 0 to 0.5 inch;

wherein the center thickened region is offset from the face center by an offset angle, the offset angle being defined between the horizontal x-axis and a line extending through the face center and the center region center, the offset angle ranges between greater than 0 and 10 degrees;

wherein the perimeter region surrounds the transition region and abuts the face perimeter, and further comprises a thickened perimeter portion located at the toe and a thinned perimeter portion located at the heel;

wherein a thickened perimeter portion thickness is in a range of 0.07 inch to 0.10 inch and a thinned perimeter portion thickness is in a range of 0.05 inch to 0.07 inch;

wherein the thickened center region comprises a center thickness ranging between 0.06 to 0.1 inch;

wherein the face further comprises a first reference point along the horizontal x-axis at approximately a 10 mm offset from the face center in a direction toward the heel; and a second reference point along the horizontal x-axis at approximately a 10 mm offset from the face center in a direction toward the toe; and wherein the characteristic time measured at approximately 10 mm intervals between the first reference point and the second reference point along the horizontal x-axis deviates less than 10 μs from the characteristic time at the face center.

15. The golf club head of claim 14, wherein the face comprises a rear surface opposite the striking surface; wherein when viewing the rear surface of the club face, the center region comprises a shape from the group consisting of elliptical, oval, circular, egg, asymmetric elliptical, and oblong-ellipse.

16. The golf club head of claim 14, wherein the characteristic time at the first reference point deviates less than 10 μs from the characteristic time measured at the second reference point.

17. The golf club head of claim 14, wherein the club head comprises a weight port configured to receive and retain a removable weight.

18. The golf club head of claim 14, wherein the golf club head comprises a center of gravity defining an origin for a coordinate system including a horizontal CG x-axis parallel to the ground and in a direction from the heel to the toe, and a vertical CG y-axis perpendicular to the ground and in a direction extending from the sole to the crown when the club head is at the address position; the club head comprises a moment of inertia Ixx measured about the CG x-axis and a moment of inertia Iyy measured about the CG y-axis.

19. The golf club head of claim 18, the moment of inertia Ixx is greater than 1400 g-cm$^2$, and the moment of inertia Iyy is greater than 2800 g-cm$^2$.

* * * * *